US009096091B2

(12) United States Patent
Shibasaki et al.

(10) Patent No.: US 9,096,091 B2
(45) Date of Patent: Aug. 4, 2015

(54) POSTPROCESSING APPARATUS, AND IMAGE FORMING APPARATUS AND IMAGE FORMING SYSTEM INCLUDING THE POSTPROCESSING APPARATUS

(71) Applicants: Yuusuke Shibasaki, Kanagawa (JP); Nobuyoshi Suzuki, Tokyo (JP); Katsuhiro Kosuge, Kanagawa (JP); Takashi Saito, Kanagawa (JP); Shingo Matsushita, Tokyo (JP); Akihiro Musha, Kanagawa (JP); Ikuhisa Okamoto, Kanagawa (JP); Wataru Takahashi, Kanagawa (JP); Takuya Morinaga, Tokyo (JP); Ryuji Yoshida, Kanagawa (JP)

(72) Inventors: Yuusuke Shibasaki, Kanagawa (JP); Nobuyoshi Suzuki, Tokyo (JP); Katsuhiro Kosuge, Kanagawa (JP); Takashi Saito, Kanagawa (JP); Shingo Matsushita, Tokyo (JP); Akihiro Musha, Kanagawa (JP); Ikuhisa Okamoto, Kanagawa (JP); Wataru Takahashi, Kanagawa (JP); Takuya Morinaga, Tokyo (JP); Ryuji Yoshida, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/091,613

(22) Filed: Nov. 27, 2013

(65) Prior Publication Data

US 2014/0151951 A1 Jun. 5, 2014

(30) Foreign Application Priority Data

Dec. 3, 2012 (JP) ..... 2012-264502

(51) Int. Cl.
*B42C 1/12* (2006.01)
*B42C 1/00* (2006.01)
(Continued)

(52) U.S. Cl.
CPC ... *B42C 1/12* (2013.01); *B42C 1/00* (2013.01); *B65H 9/04* (2013.01); *B65H 9/103* (2013.01); *B65H 31/02* (2013.01); *B65H 31/34* (2013.01); *B65H 37/04* (2013.01); *G03G 15/6538* (2013.01); *B65H 2301/363* (2013.01);
(Continued)

(58) Field of Classification Search
CPC ..... B42C 1/12; B65H 9/04; B65H 9/103; B65H 31/34; B65H 37/04; B65H 31/02; B65H 2301/3613; B65H 2301/3621; B65H 2301/363; B65H 2801/27
USPC ..... 270/58.07, 58.08, 58.11, 58.12, 58.16, 270/58.17, 58.27; 271/228, 230, 233, 236, 271/252
See application file for complete search history.

(56) References Cited

U.S. PATENT DOCUMENTS 6,264,194 B1 * 7/2001 Hayashi et al. ..... 271/220
7,435,313 B2 10/2008 Boatman et al.
(Continued)

FOREIGN PATENT DOCUMENTS

JP 36-13206 5/1961
JP 37-7208 4/1962
(Continued)

*Primary Examiner* — Leslie A Nicholson, III
(74) *Attorney, Agent, or Firm* — Harness, Dickey & Pierce, P.L.C.

(57) ABSTRACT

A postprocessing apparatus includes a stacking unit that stacks a sheet, an abutting unit that corrects a conveying direction of the sheet, a return roller that abuts the sheet against the abutting unit, a shift conveying unit that shifts the sheet in a width direction, and a width direction detector that detects a width direction position of the sheet. When the sheet is shifted by the shift conveying unit by a predetermined amount, passed to the return roller, and abutted against the abutting unit, distances A and B are nearly the same, where the distance A is a distance from a conveying direction position of a side of the sheet to a rear end of the sheet and the distance B is a distance from the return roller to the abutting unit.

17 Claims, 16 Drawing Sheets

(51) Int. Cl.

| | |
|---|---|
| ***B65H 31/34*** | (2006.01) |
| ***B65H 31/02*** | (2006.01) |
| ***B65H 9/04*** | (2006.01) |
| ***B65H 9/10*** | (2006.01) |
| ***G03G 15/00*** | (2006.01) |
| ***B65H 37/04*** | (2006.01) |

(52) U.S. Cl.
CPC . *B65H2301/3613* (2013.01); *B65H 2301/3621* (2013.01); *B65H 2301/4213* (2013.01); *B65H 2404/1424* (2013.01); *B65H 2404/1523* (2013.01); *B65H 2404/166* (2013.01); *B65H 2801/27* (2013.01)

(56) References Cited

U.S. PATENT DOCUMENTS

| | | | | |
|---|---|---|---|---|
| 7,445,207 | B2 * | 11/2008 | Obuchi et al. | 271/228 |
| 7,520,497 | B2 * | 4/2009 | Moriyama et al. | 270/58.07 |
| 7,581,725 | B2 | 9/2009 | Fujita et al. | |
| 7,866,652 | B2 | 1/2011 | Fujita et al. | |
| 8,066,279 | B2 * | 11/2011 | Ishikawa et al. | 271/228 |
| 8,308,154 | B2 * | 11/2012 | Miyake et al. | 270/58.17 |
| 2010/0202814 | A1 | 8/2010 | Nakamura | |
| 2013/0001848 | A1 | 1/2013 | Hidaka et al. | |
| 2013/0011219 | A1 | 1/2013 | Musha et al. | |
| 2013/0154178 | A1 | 6/2013 | Suzuki et al. | |

FOREIGN PATENT DOCUMENTS

| | | |
|---|---|---|
| JP | 07-165365 | 6/1995 |
| JP | 4038101 | 11/2007 |
| JP | 2007-536141 | 12/2007 |
| JP | 2009-31489 | 2/2009 |
| JP | 4307429 | 5/2009 |
| JP | 2010-208854 | 9/2010 |
| JP | 2010-274623 | 12/2010 |
| JP | 2011-201652 | 10/2011 |
| WO | WO2009/110298 A1 | 9/2009 |

* cited by examiner (a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

POSTPROCESSING APPARATUS, AND IMAGE FORMING APPARATUS AND IMAGE FORMING SYSTEM INCLUDING THE POSTPROCESSING APPARATUS

CROSS-REFERENCE TO RELATED APPLICATIONS

The present application claims priority to and incorporates by reference the entire contents of Japanese Patent Application No. 2012-264502 filed in Japan on Dec. 3, 2012.

BACKGROUND OF THE INVENTION

1. Field of the Invention

The present invention relates to a postprocessing apparatus attached to an image forming apparatus such as a printer and a copying machine, and an image forming apparatus and an image forming system including the postprocessing apparatus, and in particular, to a postprocessing apparatus that performs sheet bundling and aligning processing, and an image forming apparatus and an image forming system including the postprocessing apparatus.

2. Description of the Related Art

Already known is a finisher as a postprocessing apparatus that once accumulates sheets output from a copying machine or a printer in a stacking tray, aligns them, and performs binding processing thereon with, for example, a stapler using metal staples. Among such finishers, one capable of binding 50 sheets is the mainstream.

Thus, the conventional postprocessing apparatus binds a relatively large number of sheets. When aligning a sheet bundle, the postprocessing apparatus aligns a large number of sheets collectively through a width direction aligning unit such as a jogger. Such a conventional postprocessing apparatus requires space for the aligning unit for aligning a sheet bundle and an aligning unit configuration (a drive source) for aligning. For this reason, in most cases, the configuration of the conventional postprocessing apparatus cannot be simplified, and its size is nearly the same as that of a copying machine or a printer, leading to problems of cost increase, space management, and increased consumption of resources.

As one of such conventional postprocessing apparatuses, for example, Japanese Patent No. 4307429 discloses a sheet processing apparatus that can reduce the time for sheet aligning operation by an aligning unit. Disclosed therein is a technology that, using the aligning unit that stacks and aligns a sheet bundle in a sheet stacking unit, a shift conveying unit that is provided at the upstream side of the sheet stacking unit, and a detector that detects the width direction position of a sheet, shifts the sheet to a predetermined position through the shift conveying unit when the sheet is conveyed to the stacking unit and moves the aligning unit provided on the stacking unit to a vicinity of the predetermined position before the sheet is conveyed to the stacking unit.

In the technology disclosed in Japanese Patent No. 4307429, a sheet is shifted to the predetermined position through a shift roller and a width direction detector (a lateral registration detector) and is conveyed to the postprocessing apparatus. However, because the postprocessing apparatus has the width direction detector installed, the postprocessing apparatus cannot be simplified and thus problems of cost increase, space management, and increased consumption of resources cannot be solved.

The typical number of sheets bound in an office is as small as about five. When such a small number of sheets of about five are subjected to width direction aligning processing at the upstream side of the postprocessing apparatus and conveyed to the postprocessing apparatus, a large width direction deviation is less likely to occur as compared to 50-sheet binding, and only a small width direction deviation occurs.

Thus, because only a small deviation in the width direction occurs in the width direction aligning processing by the postprocessing apparatus for a small number of sheets, it is considered that eliminating the width direction aligning unit in the postprocessing unit can simplify the configuration of the postprocessing apparatus, reduce costs, save space, and further minimize the amount of width direction deviation of a sheet bundle.

An object of the present invention is, in view of the fact that the typical number of sheets bound in an office is as small as about five, to provide a postprocessing apparatus, and an image forming apparatus and an image forming system including the postprocessing apparatus that can simplify its configuration, reduce costs, save space, and further minimize the amount of width direction deviation of a sheet bundle by eliminating the width direction aligning unit in the postprocessing unit.

SUMMARY OF THE INVENTION

It is an object of the present invention to at least partially solve the problems in the conventional technology.

According to the present invention, there is provided: a postprocessing apparatus, comprising: a stacking unit configured to stack and process a sheet; an abutting unit that is provided on the stacking unit and configured to abut a rear end of the sheet to correct a conveying direction of the sheet; a conveying unit comprising a rotating body that conveys the sheet to abut the sheet against the abutting unit on the stacking unit; a shift conveying unit that is provided at an upstream side of the stacking unit and configured to shift the sheet in a width direction and conveys the sheet; and a width direction detector configured to detect a width direction position of the sheet. In the above-described postprocessing apparatus, when the sheet is shifted by the shift conveying unit by a predetermined amount until a side of the sheet is detected by the width direction detector, conveyed onto the stacking unit, passed to the conveying unit, and abutted against the abutting unit, distances A and B are nearly the same, where the distance A is a distance from a conveying direction position of the side of the sheet detected by the width direction detector to the rear end of the sheet and the distance B is a distance from the conveying unit on the stacking unit to the abutting unit.

The present invention also provides an image forming apparatus comprising a postprocessing apparatus, wherein the postprocessing apparatus comprises: a stacking unit configured to stack and process a sheet; an abutting unit that is provided on the stacking unit and configured to abut a rear end of the sheet to correct a conveying direction of the sheet; a conveying unit comprising a rotating body that conveys the sheet to abut the sheet against the abutting unit on the stacking unit; a shift conveying unit that is provided at an upstream side of the stacking unit and configured to shift the sheet in a width direction and conveys the sheet; and a width direction detector configured to detect a width direction position of the sheet. In the above-described image forming apparatus, when the sheet is shifted by the shift conveying unit by a predetermined amount until a side of the sheet is detected by the width direction detector, conveyed onto the stacking unit, passed to the conveying unit, and abutted against the abutting unit, distances A and B are nearly the same, where the distance A is a distance from a conveying direction position of the side of the sheet detected by the width direction detector to the rear end of the sheet and the distance B is a distance from the conveying unit on the stacking unit to the abutting unit.

The present invention also provides an image forming system comprising a postprocessing apparatus, wherein the postprocessing apparatus comprises: a stacking unit configured to stack and process a sheet; an abutting unit that is provided on the stacking unit and configured to abut a rear end of the sheet to correct a conveying direction of the sheet; a conveying unit comprising a rotating body that conveys the sheet to abut the sheet against the abutting unit on the stacking unit; a shift conveying unit that is provided at an upstream side of the stacking unit and configured to shift the sheet in a width direction and conveys the sheet; and a width direction detector configured to detect a width direction position of the sheet. In the above-described image forming system, when the sheet is shifted by the shift conveying unit by a predetermined amount until a side of the sheet is detected by the width direction detector, conveyed onto the stacking unit, passed to the conveying unit, and abutted against the abutting unit, distances A and B are nearly the same, where the distance A is a distance from a conveying direction position of the side of the sheet detected by the width direction detector to the rear end of the sheet and the distance B is a distance from the conveying unit on the stacking unit to the abutting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
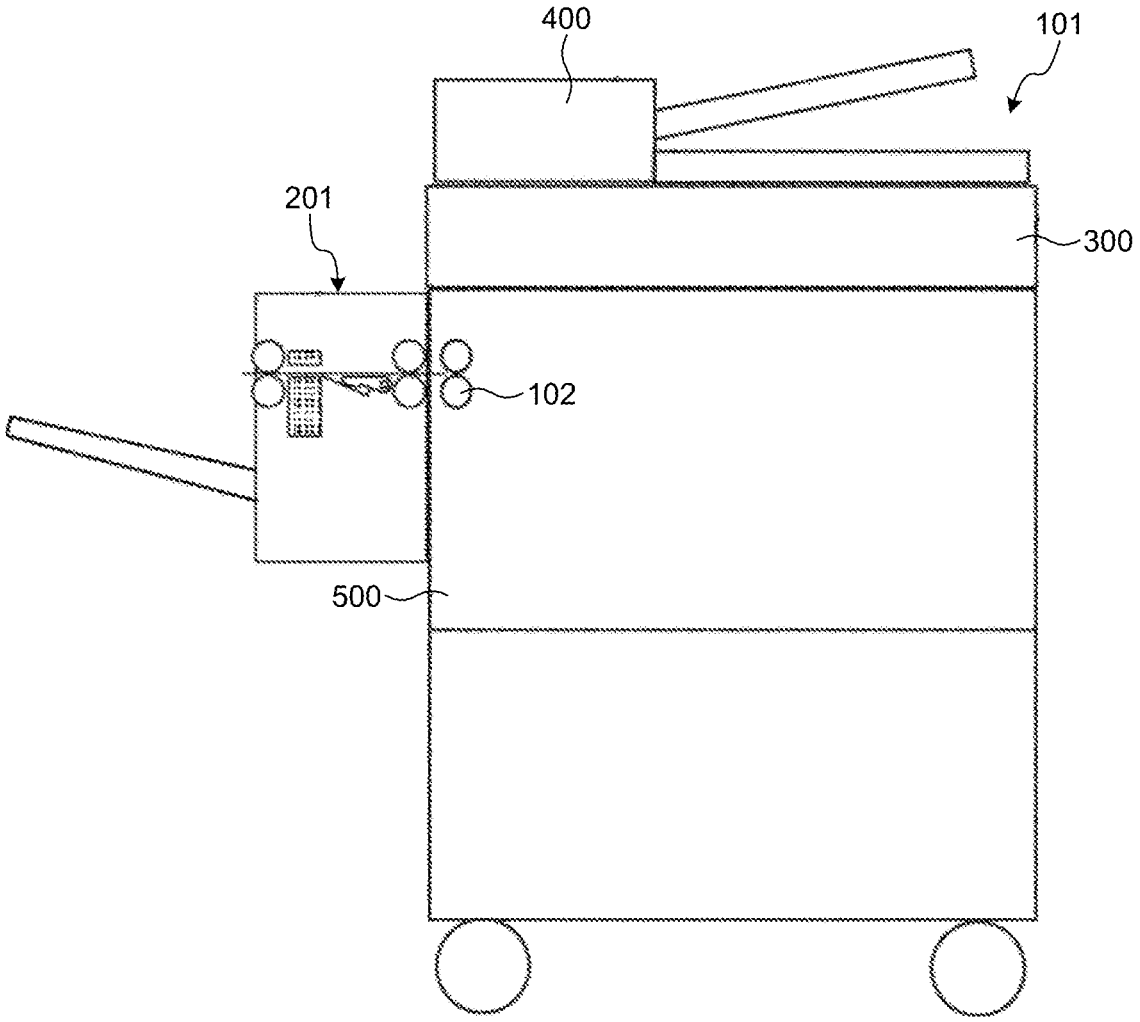
FIG. 1 is an overall configuration diagram of a postprocessing apparatus and a copying machine as an image forming apparatus attached to the postprocessing apparatus as an embodiment according to the present invention.

The following describes embodiments according to the present invention with reference to the accompanying drawings. Throughout the embodiments and modifications or the like, the same reference numerals will be given to constituents such as members and components having the same function or shape, as far as discrimination is possible. Once any of them is described, its description will be omitted thereafter.

The present invention has the following features on the width direction alignment of a sheet bundle. In a postprocessing apparatus, a sheet is shifted by a predetermined amount until a side of the sheet is detected by a width direction detector by a shift conveying unit. After being conveyed onto a stacking unit, the sheet is passed to, for example, a return roller as a conveying unit forming a rotating body and then is abutted against a abutting Plate serving as a reference fence. This process is repeated to perform stacking, thereby performing the width direction alignment of the sheet bundle. Specifically, distances A and B are made nearly the same, where the distance A is a distance from a conveying direction position at which a side of the sheet is detected by the width direction detector to the rear end of the sheet and the distance B is a distance from the return roller to the reference fence. This can minimize the amount of width direction deviation of the sheet bundle to improve the accuracy of the width direction alignment of the sheet bundle, and in particular, lead to a simplified configuration of the postprocessing apparatus without a width direction aligning unit on the stacking unit.

Described first with reference to FIG. 1 to FIGS. 4(*a*) and 4(*b*) is the overall configuration of an image forming apparatus having a postprocessing apparatus as a first embodiment according to the present invention. This image forming apparatus 101 is a color copying machine.

The color copying machine 101 includes a scanner 300 having an automatic document conveying device 400 that automatically feeds a document. Image formation is performed by a printer (an image forming unit) 500 according to image signals from this scanner 300 and other image signal input devices (not illustrated). In the printer 500, a four-color toner image corresponding to a document image is transferred to a fed sheet, and after fixing processing, the sheet with the four-color toner image fixed is sent out through a sheet discharge roller 102 to a postprocessing apparatus 201.

Figure 2:
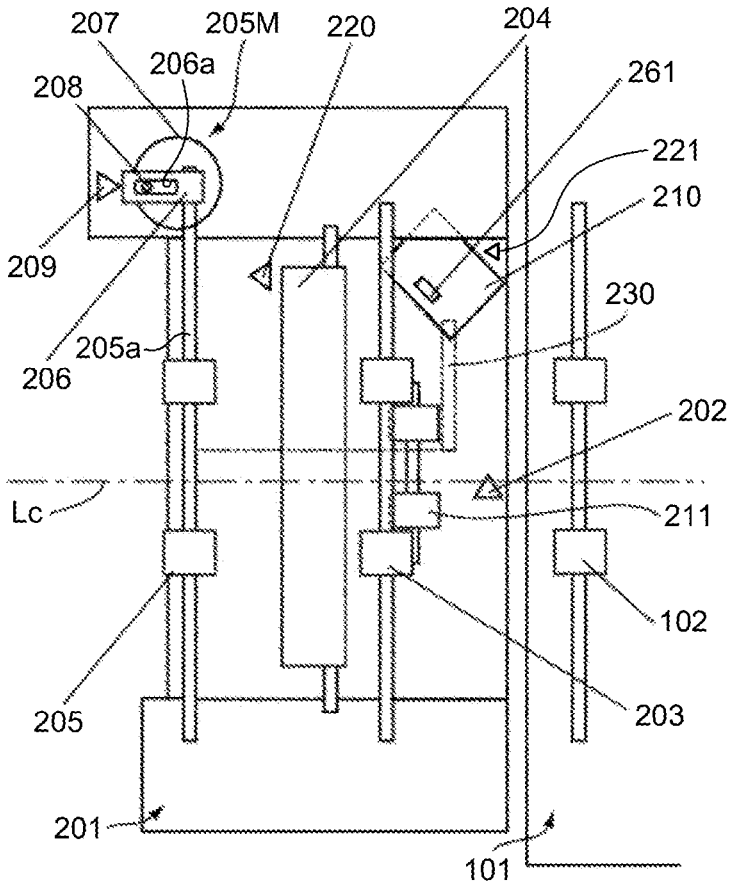
FIGS. 2(*a*) and 2(*b*) illustrate the postprocessing apparatus in FIG. 1, FIG. 2(*a*) being a schematic plan view and FIG. 2(*b*) being a schematic side view.
Figure 2:
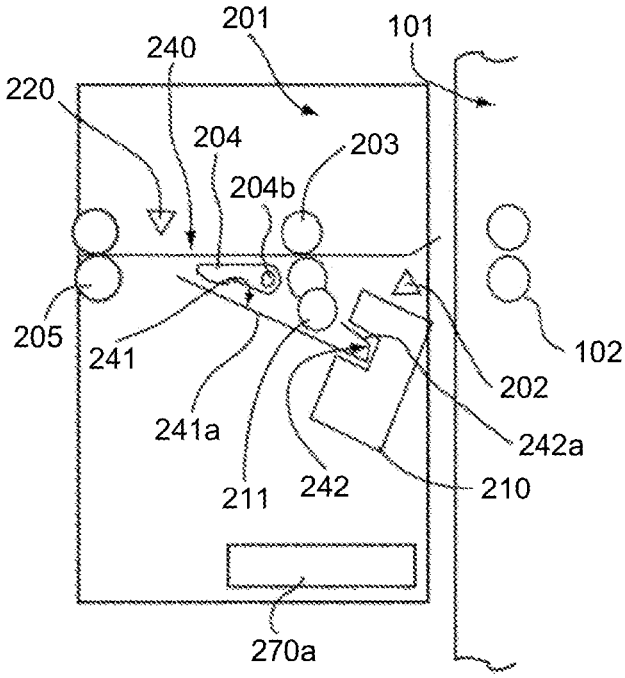

As illustrated in FIGS. 2(*a*) and 2(*b*), the postprocessing apparatus 201 includes, along a sheet conveying path 240 from the entrance side, an entrance sensor 202, an entrance roller 203, a bifurcating claw 204, a branch path forming member 241*a*, a return roller 211, a binder 210, and a sheet discharge roller 205.

The branch path forming member 241*a* is formed so as to branch off from the sheet conveying path 240 and is a stacking unit that stacks and processes sheets. This branch path forming member (the stacking unit) 241*a* includes an abutting plate 242*a* (an abutting unit) that functions as a reference fence against which the rear end of a sheet is abutted, thereby correcting the conveying direction. This abutting plate 242*a* forms an abutting surface 242 and functions as the reference fence.

The return roller (a roller) 211 as a rotating body that conveys a sheet so as to be abutted against the abutting plate 242*a* (the abutting unit) forming the reference fence is provided on the branch path forming member (the stacking unit) 241*a*.

As illustrated in FIGS. 2(*a*) and 2(*b*), the return roller 211 as a rotating body is provided at the width direction center of the sheet and is provided as one pair of bodies spaced apart right and left in the width direction by a predetermined spacing from a width direction center line Lc of the sheet. The one pair of return rollers 211 are integrally supported by a rotating shaft that rotates with its rotation axis pointing in the width direction of the sheet and are coupled to a drive motor (not illustrated) through the rotating shaft. The drive motor is controlled by a CPU 270*a*. As illustrated in FIGS. 2(*a*) and 2(*b*), the return rollers 211 are short, cylindrical rotating bodies. However, they may be in some cases a short cylindrical shape with its both ends chamfered or a shape with an arc-shaped cross section, being not limited to the present embodiment.

The pair of return rollers 211 function, through its rotational drive, to convey the sheet in a direction along the width direction center line Lc on a branch path 241. In this process, they are controlled by the CPU 270*a* so that they rotate in the return direction when conveying toward the abutting plate 242*a* forming the reference fence and rotate in the sheet discharging direction when discharging the sheet.

As illustrated in FIGS. 2(*a*) and 2(*b*), the entrance sensor 202 detects the front end and the rear end of a sheet discharged through a sheet discharge roller 102 of the copying machine as the image forming apparatus 101 and conveyed to the postprocessing apparatus 201, and the presence or absence of the sheet. The entrance sensor 202 may be, for example, a reflection type optical sensor. A transmission type optical sensor may be used in place of the reflection type optical sensor. The entrance roller 203 is positioned at the entrance of the postprocessing apparatus 201 and has functions of receiving the sheet discharged through the sheet discharge roller 102 of the image forming apparatus 101 and conveying it to the binder 210 as a stapling device. As described below, also provided are a drive source (a drive motor) capable of controlling stop, rotation, and the amount of conveyance and the CPU 270*a* that controls the drive source. The entrance roller 203 also performs skew correction by abutting the front end of the sheet conveyed from the image forming apparatus 101 against a nip between the entrance roller 203 and its counter roller.

The bifurcating claw 204 is provided at the rear stage of the entrance roller 203. The bifurcating claw 204 is provided to guide the rear end of the sheet to the branch path 241. In this case, after the rear end of the sheet passes by the bifurcating claw 204, the bifurcating claw 204 rotates clockwise in the drawing to convey the sheet in a direction opposite the conveying direction. This guides the rear end side of the sheet toward the branch path 241. As described below, the bifurcating claw 204 is driven by a solenoid and performs oscillating operation. A motor may be used in place of the solenoid. When driven and rotated counterclockwise in the drawing, the bifurcating claw 204 can press a sheet or sheet bundle against the conveying surface of the branch path 241. This allows the bifurcating claw 204 to secure the sheet or sheet bundle through the branch path forming member 241*a* forming the branch path 241.

The sheet discharge roller 205 is positioned immediately before the exit of the rearmost stage of the sheet conveying path 240 of the postprocessing apparatus 201 and has functions of conveying, shifting, and discharging a sheet (although sheet shifting is performed by the sheet discharge roller for description, it may be performed by the entrance roller positioned at the upstream side thereof by one stage). As is the case with the entrance roller 203, provided is a drive source (a drive motor) capable of controlling stop, rotation, and the amount of conveyance of the sheet discharge roller 205, and the drive source is controlled by the CPU 270*a*. The shift of the sheet discharge roller 205 is performed by a shift conveying unit 205M. The shift conveying unit 205M includes a shift link 206, a shift cam 207, a shift cam stud 208, and a shift home position sensor 209.

The shift link 206 is provided on a shaft end 205*a* of the sheet discharge roller 205 and receives a shift moving force. The shift cam 207 having the shift cam stud 208 is a rotating disc-shaped component. The shift cam stud 208 is located in a shift link slot 206*a* of the shift link. Thus, the shift cam 207 rotates itself to shift the sheet discharge roller 205 in the width direction orthogonal to the sheet conveying direction. This movement is what is called shift movement. The shift cam stud 208 has a function of, in conjunction with the shift link slot 206*a*, converting the rotational motion of the shift cam 207 into the linear motion of the sheet discharge roller 205 in its axial direction. The shift home position sensor 209 detects the position of the shift link 206, sets the position detected by the shift home position sensor 209 as a home position, and performs the rotation control of the shift cam 207 with respect to this home position. This control is performed by the CPU 270*a*.

The binder 210 includes a sheet end detecting sensor 220 as a width direction position detecting unit that detects the position of a sheet in the width direction, a binder home position sensor 221, and a guide rail 230 for the movement of the binder. The binder 210 is a mechanism for binding a sheet bundle PB, which is what is called the stapler. In the present embodiment, the binder 210 has a function of deforming sheets by holding them between a pair of tooth forms 261 to press them and binding them through the entanglement of the fibers of the sheets. This kind of binding is also called crimp binding. In addition to this method for binding, also known is a hand stapler using a binder of some ways of binding such as half blanking, cutting and bending, and cutting and bending and further inserting into a hole. Any of those largely contributes to resources saving because they reduce supply consumption, facilitate recycling, and allow a sheet bundle to be thrown into a shredder without being processed. This evokes a need to install, on the postprocessing apparatus, or what is called the finisher, a stapler that does not use metal staples and performs binding processing with sheets alone as in crimp binding.

A hand stapler that performs crimp binding is known by, for example, a binder disclosed in Japanese Examined Utility Model Application Publication No. S36-13206. A hand stapler that binds through cutting and bending and further inserting into a hole is known by, for example, a binder disclosed in Japanese Examined Utility Model Application Publication No. S37-7208.

As illustrated in FIG. 2(*a*), the sheet end detecting sensor 220 is a sensor that detects a side of the sheet. The sheet is aligned with respect to this sensor detection position. For example, the sensor detects a sheet width direction position where the binder performs binding processing, and the sheet is aligned with the position. The binder home position sensor 221 is a sensor that detects the position of the binder capable of moving in the sheet width direction. This sensor detects the position of the binder at which the binder does not obstruct conveyance of a sheet of the maximum size and sets the position as a home position. As indicated by a two-dot chain line in FIG. 2(*a*), the guide rail 230 is a rail that guides the movement of the binder 210 so that the binder 210 can move stably in the sheet width direction. The guide rail 230 is installed so that the binder 210 can move in a direction orthogonal to the sheet conveying direction of the sheet conveying path 240 of the postprocessing apparatus 201 from the home position to a position to bind a sheet of the minimum size. The binder 210 moves along the guide rail 230 through a moving mechanism including a drive motor (not illustrated).

As illustrated in FIG. 2(*b*), the sheet conveying path 240 is a conveying path for conveying and discharging a received sheet and passes through from the entrance side to the exit side of the postprocessing apparatus 201. The branch path 241 is a conveying path for reversely conveying (switching back) a sheet to feed it with its rear end side first, and branches off from the sheet conveying path 240. The branch path 241 is provided to stack and align sheets, and its branch path forming member 241*a* functions as a stacking unit or a staple tray. The abutting surface 242 is formed on the abutting plate 242*a* supported on an end of the branch path forming member 241*a*, formed on an end of the branch path 241, and forms a reference plane against which the rear end of the sheet is abutted and aligned. The tooth form 261 (see FIG. 4) in the present embodiment is a press holding member having a shape such that a projection and a recession mesh with each other, and holds and presses a sheet bundle to perform the above-described crimp binding function.

Figure 3:
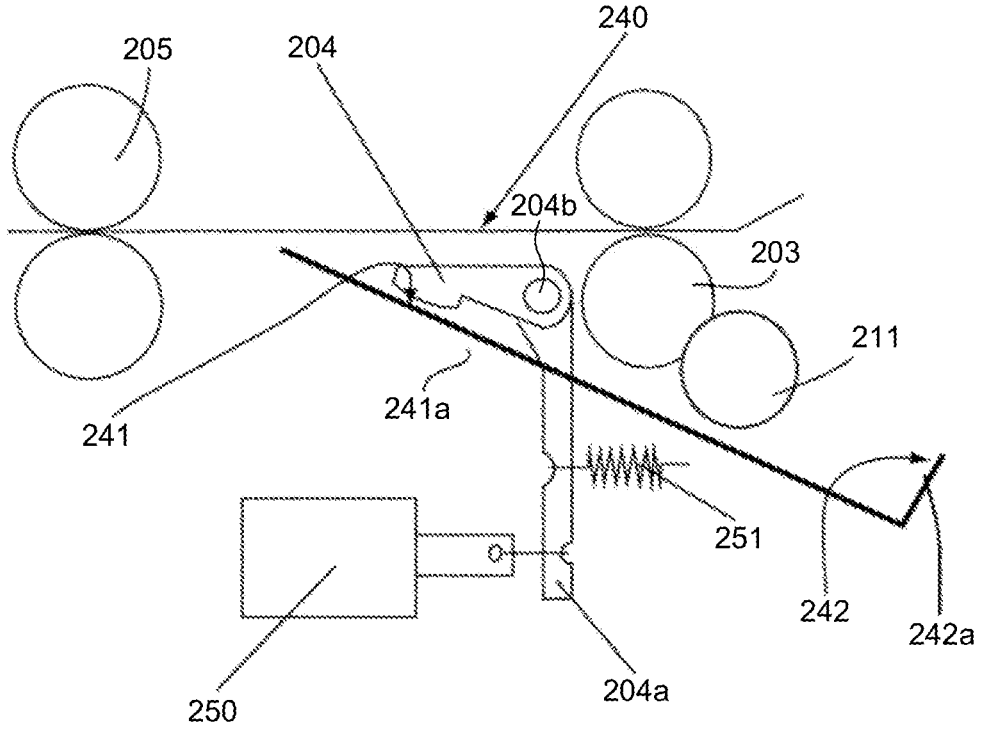
FIGS. 3(*a*) and 3(*b*) illustrate a bifurcating claw for use in the postprocessing apparatus in FIG. 1, FIG. 3(*a*) being a schematic side view when holding and FIG. 3(*b*) being a schematic side view when releasing.
Figure 3:
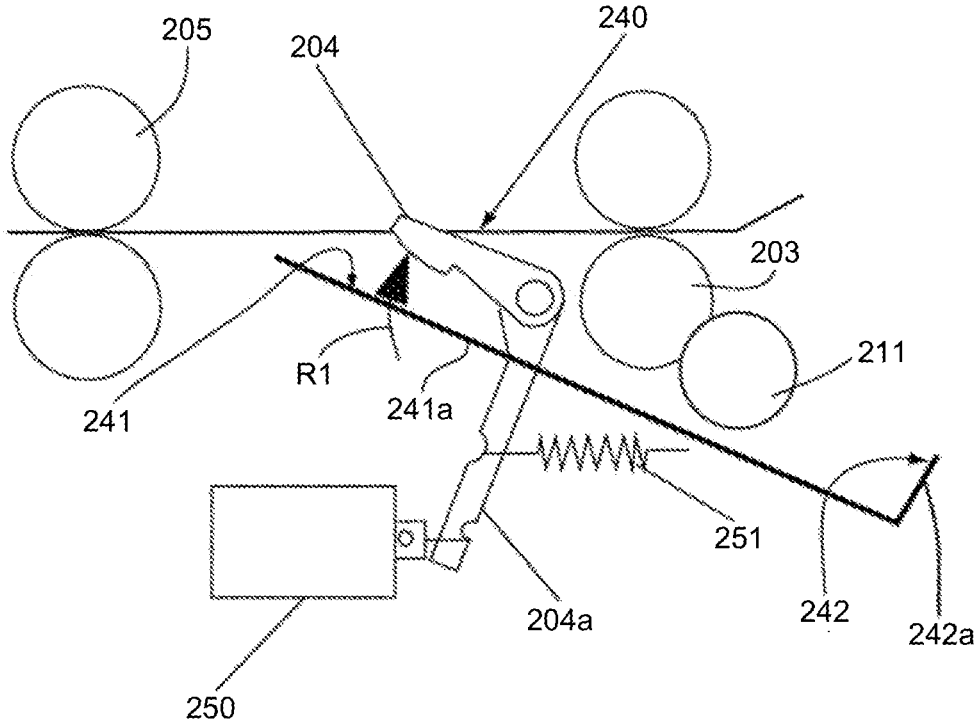

FIGS. 3(*a*) and 3(*b*) illustrate the details of a related mechanism at switching back the principal part of the postprocessing apparatus 201 centering on the bifurcating claw 204. The bifurcating claw 204 is provided oscillatably within a predetermined angle range with respect to a support shaft 204*b* in order to switch a sheet conveying path between the sheet conveying path 240 and the branch path 241. The bifurcating claw 204 has its home position at a position where a sheet received from the right in the drawing can be conveyed to the downstream side smoothly, that is, the position illustrated in FIG. 3(*a*), and is elastically pressed through a spring 251 counterclockwise in the drawing at all times.

The spring 251 is hooked on a bifurcating claw moving lever 204*a*, and the bifurcating claw moving lever 204*a* is coupled to a plunger of a branching solenoid 250. After a sheet is conveyed to the branch path 241 in a status illustrated in FIG. 3(*b*), in a status illustrated in FIG. 3(*a*), a conveying surface of the branch path 241 and the bifurcating claw 204 can hold the sheet in the branch path 241 therebetween. Concerning the switching of the conveying path, when the branching solenoid 250 is turned on, the bifurcating claw 204 turns in a direction indicated by an arrow R1 in FIG. 3(*b*) to close the sheet conveying path 240 and open the branch path 241, thereby guiding the sheet to the branch path 241.

Figure 4:
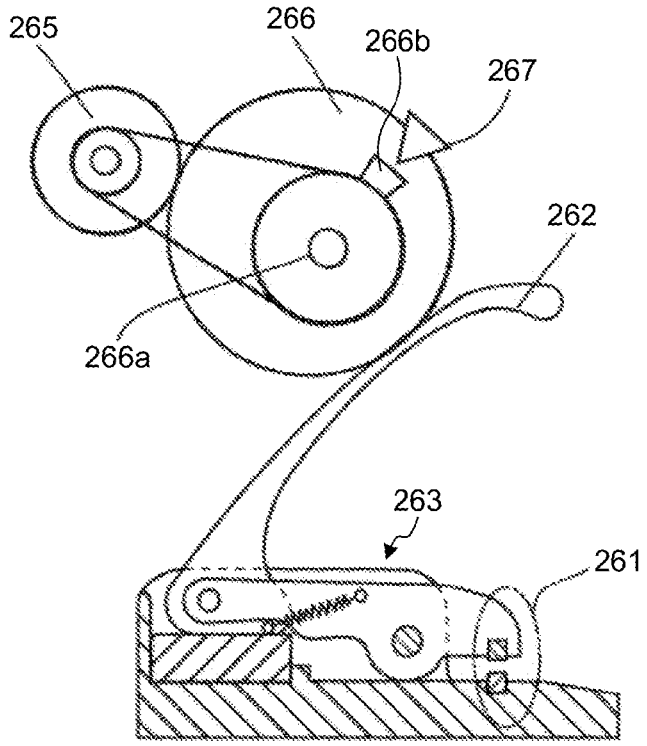
FIGS. 4(*a*) and 4(*b*) illustrate a binder for use in the postprocessing apparatus in FIG. 1, FIG. 4(*a*) being a schematic side view when not holding and FIG. 4(*b*) being a schematic side view when holding.
Figure 4:
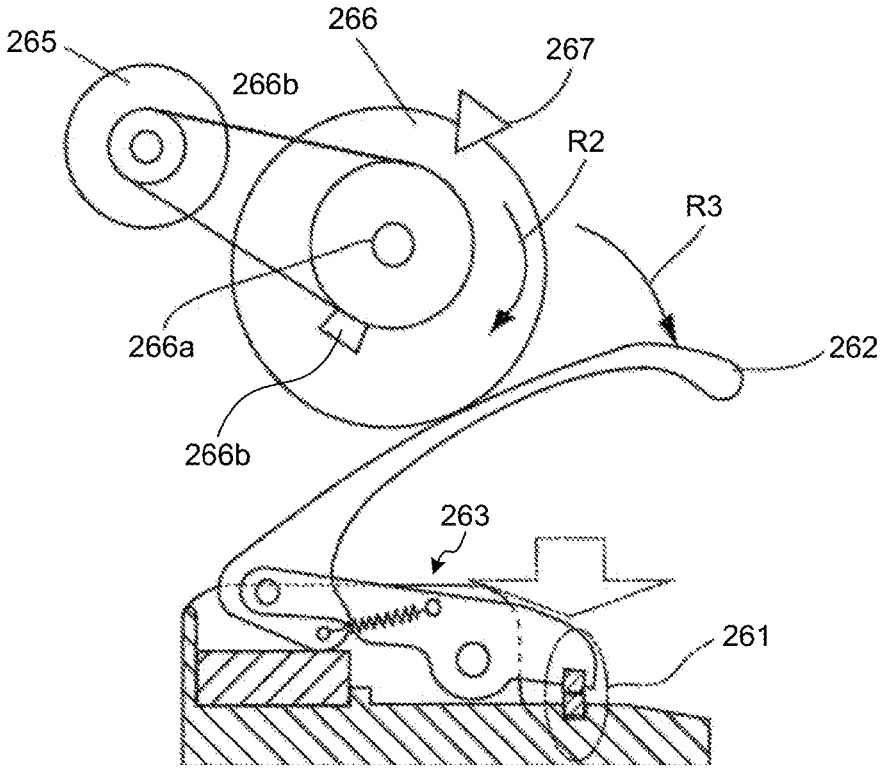

FIGS. 4(*a*) and 4(*b*) are diagrams illustrating the details of the binder 210 according to the present embodiment. The binder 210 includes the tooth form 261, a pressing lever 262, a link group 263, a drive motor 265, an eccentric cam 266, and a cam home position sensor 267 as constituents. The tooth form 261 is a pressing member having a shape in which a pair of upper and lower bodies mesh with each other. The tooth form 261 is positioned at the working end of the plurally combined link group 263 and performs contact and separation through the pressing and press releasing operations of the pressing lever 262 as the operating end.

The pressing lever 262 turns by the rotating eccentric cam 266. The eccentric cam 266 is given driving force by the drive motor 265 to rotate, and the rotational position of the cam is controlled based on the detection information of the cam home position sensor 267. The rotational position defines a distance between a rotating shaft 266*a* of the eccentric cam 266 and the cam surface, and based on this distance, the pressing amount of the pressing lever 262 is determined. A position at which the cam home position sensor 267 detects a filler 266*b* as a detection target of the eccentric cam 266 is a home position. As illustrated in FIG. 4(*a*), when the rotational position of the eccentric cam 266 is at the home position, the tooth form 261 is in an open state. In this state, the tooth form 261 cannot perform binding processing and can receive a sheet bundle.

When a sheet bundle is bound, with the tooth form 261 open as illustrated in FIG. 4(*a*), the sheet bundle is inserted into between the members of the tooth form 261, and the drive motor 265 rotates. Upon the starting of the rotation of drive motor 265, the eccentric cam 266 rotates in a direction indicated by an arrow R2 in FIG. 4(*b*).

In accordance with this rotation, the cam surface of the eccentric cam 266 displaces, and the pressing lever 262 turns in a direction indicated by an arrow R3 in the drawing. The turning force increases through the link group utilizing the action of a lever and is transmitted to the tooth form 261 at the working end.

When the eccentric cam 266 rotates by a certain amount, the upper and lower members of the tooth form 261 mesh with each other to hold the sheet bundle therebetween and presses it. Through this pressing, the sheet bundle becomes deformed, and the fibers of adjacent sheets are entangled to cause the sheet bundle to be bound. The drive motor 265 then rotates in the opposite direction and stops based on the detection information of the cam home position sensor 267. This returns the upper and lower members of the tooth form 261 to the status in FIG. 4(*a*), in which the sheet bundle can be moved. The pressing lever 262 has springiness; when an overload is placed, it relieves the overload.

Figure 5:
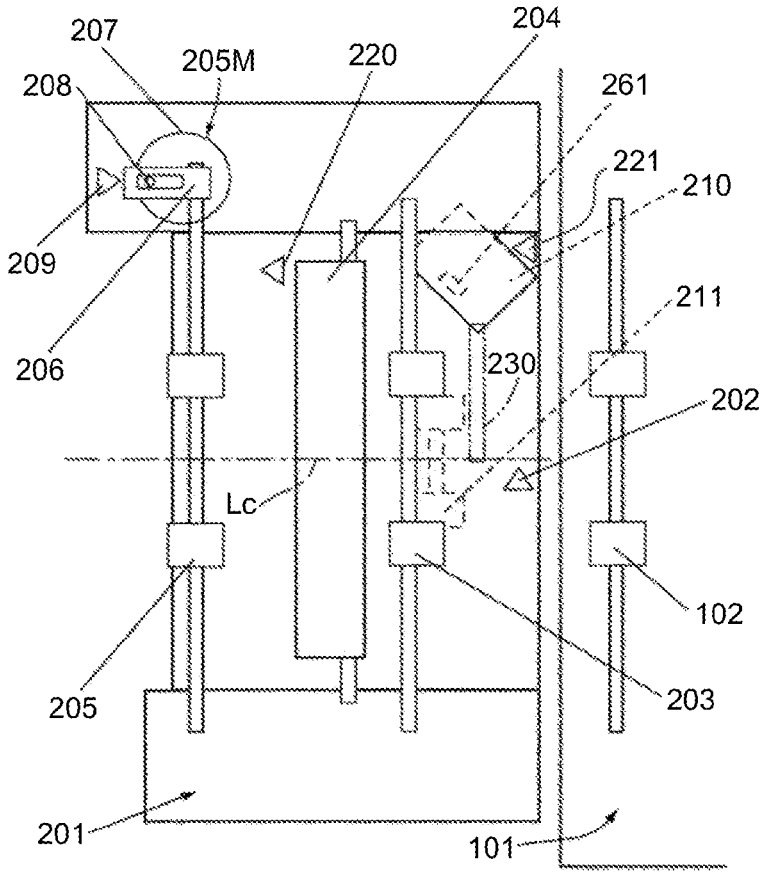
FIGS. 5(*a*) and 5(*b*) are operation illustration diagrams of the postprocessing apparatus in FIG. 1 being on standby, FIG. 5(*a*) being a schematic plan view and FIG. 5(*b*) being a schematic side view.
Figure 5:
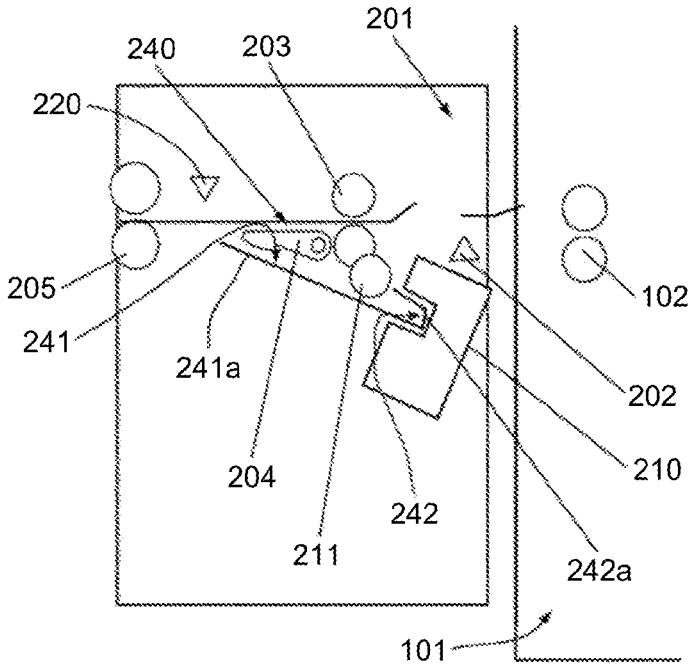
Figure 11:
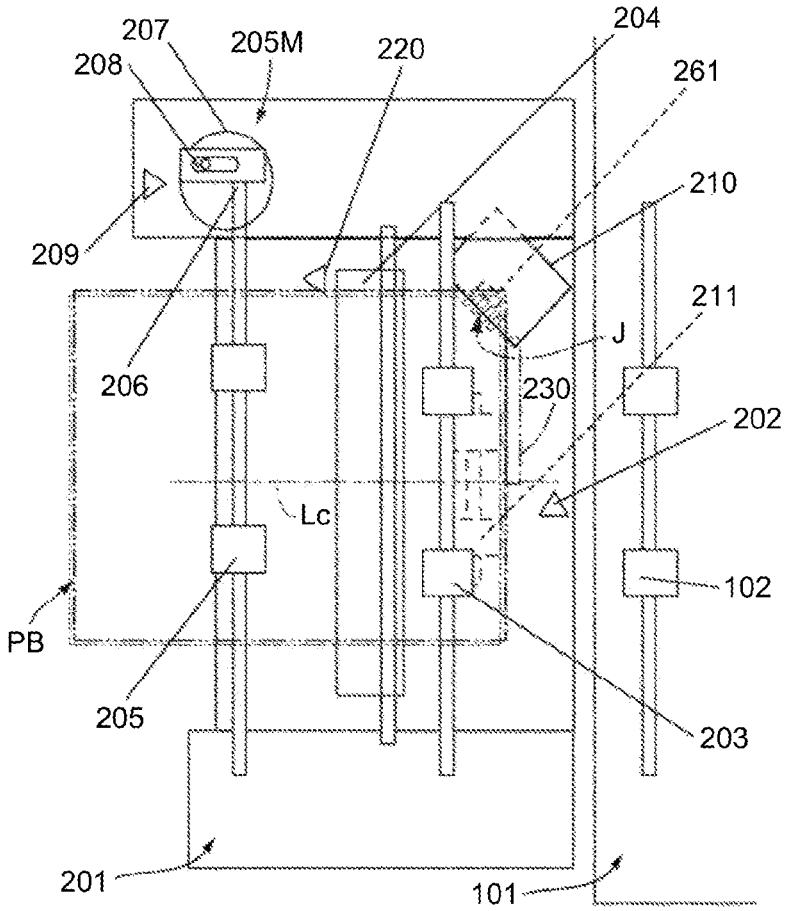
FIGS. 11(*a*) and 11(*b*) are operation illustration diagrams after a sheet bundle is created, and the sheet bundle is stacked on the conveying path by the postprocessing apparatus in FIG. 1, FIG. 11(*a*) being a plan view and FIG. 11(*b*) being a schematic side view.
Figure 11:
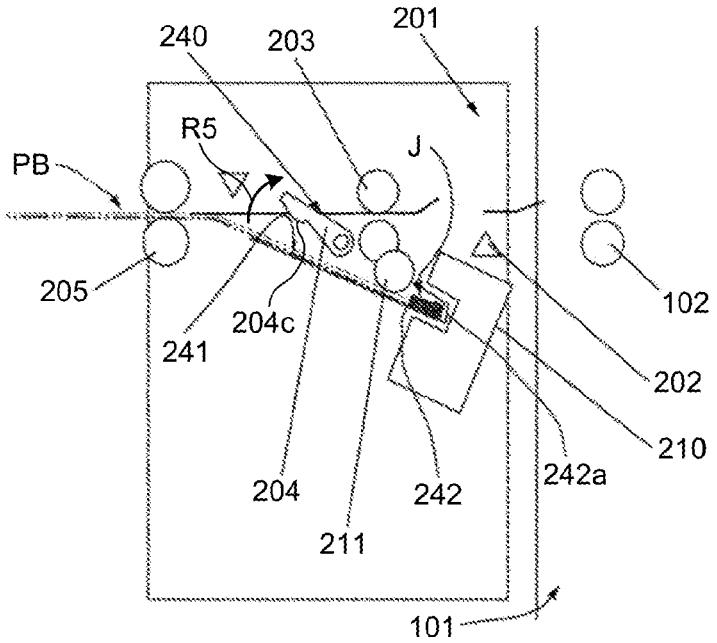

FIGS. 5(*a*) and 5(*b*) to FIGS. 11(*a*) and 11(*b*) are operation illustration diagrams illustrating the binding operation of online binding by the binder 210 of the postprocessing apparatus 201. In each of the drawings, (a) is a plan view, and (b) is a schematic side view. The online binding in the present embodiment refers to, with the postprocessing apparatus 201 installed in the sheet discharge area of the sheet discharge roller 102 of the image forming apparatus 101 as illustrated in FIG. 1, receiving and aligning sheets on which images are formed by the image forming apparatus 101 successively by the postprocessing apparatus 201, thereby performing binding processing. Manual binding described below refers to binding sheets output from the image forming apparatus 101 or a separate printing apparatus through the binder 210 of the postprocessing apparatus 201. Because the manual binding does not perform binding through a series of operations following the sheet discharge of the image forming apparatus 101, it is included in offline binding.

FIGS. 5(*a*) and 5(*b*) are diagrams illustrating a status at the completion of the initial operation of the online binding by the postprocessing apparatus 201.

Upon the starting of the output of the sheets on which images are formed from the image forming apparatus 101, the units move to their respective home positions to complete initializing. FIGS. 5(*a*) and 5(*b*) illustrate a status at that time.

Figure 6:
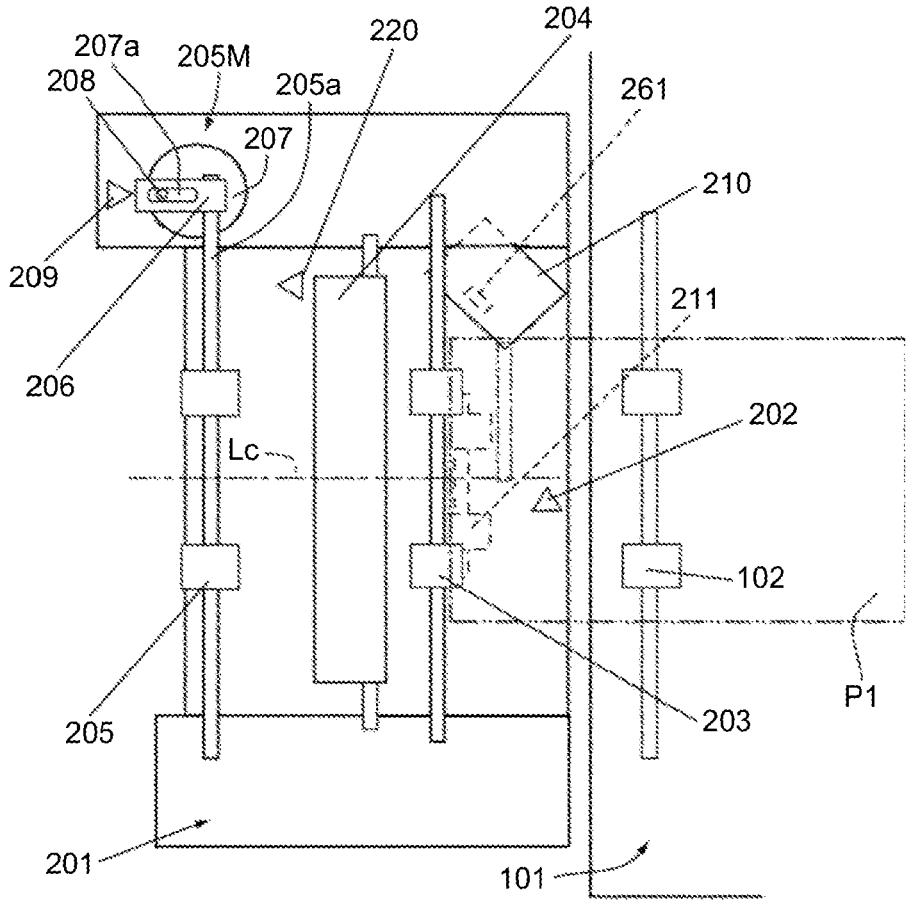
FIGS. 6(*a*) and 6(*b*) are operation illustration diagrams when a sheet is fed by the postprocessing apparatus in FIG. 1, FIG. 6(*a*) being a plan view and FIG. 6(*b*) being a schematic side view.
Figure 6:
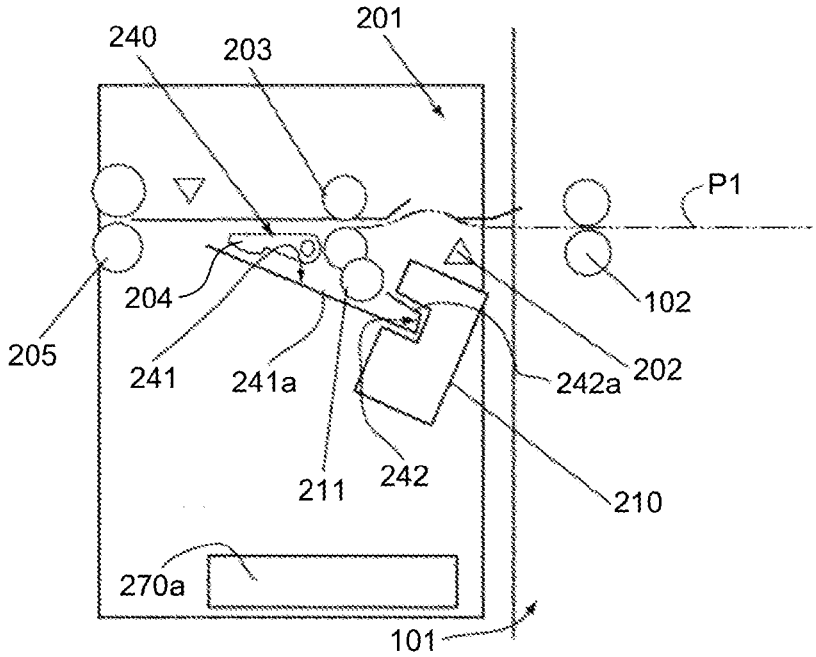

FIGS. 6(*a*) and 6(*b*) are diagrams illustrating a status immediately after a first sheet P1 is discharged from the image forming apparatus 101 and is fed into the postprocessing apparatus 201. Before the sheet P1 is fed from the image forming apparatus 101 into the postprocessing apparatus 201, the CPU 270*a* of the postprocessing apparatus 201 receives mode information on the control mode of sheet processing and sheet information from a CPU (not illustrated) of the image forming apparatus 101, and based on the information, becomes a receiving standby status.

The control mode has three modes, namely, a straight mode, a shift mode, and a binding mode. In the straight mode, the entrance roller 203 and the sheet discharge roller 205 start rotation in the sheet conveying direction in the receiving standby status. Sheets P1, . . . , Pn are successively conveyed and discharged, and after the last sheet Pn is discharged, the entrance roller 203 and the sheet discharge roller 205 stop. Note that n is a positive integer of 2 or more.

In the shift mode, the entrance roller 203 and the sheet discharge roller 205 start rotation in the conveying direction in the receiving standby status. In shift discharge operation, the sheet P1 is received and conveyed, and when the rear end of the sheet P1 passes by the entrance roller 203, the shift cam 207 rotates by a certain amount, and the sheet discharge roller 205 shifts in the sheet width direction as the shaft direction. The sheet P1 also moves together with the movement of the sheet discharge roller 205. Upon the sheet P1 being discharged from the postprocessing apparatus 201, the shift cam 207 rotates to return to its home position and prepares for the feed of the next sheet P2 (see FIG. 9(*a*)). This shift operation of the sheet discharge roller 205 is repeated until the discharge of the sheet Pn of the same copy is completed. This causes one copy (one volume) of the sheet bundle PB (see FIG. 11(*b*)) to be discharged and stacked while being shifted to one direction. Upon the first sheet P1 of the next copy being fed, the shift cam 207 rotates in the opposite direction as with the previous copy, and the sheet P1 is moved to the opposite side of the previous copy and discharged.

In the binding mode, the entrance roller 203 is at a stop, and the sheet discharge roller 205 starts rotation in the conveying direction in the receiving standby status. The binder 210 retracts to a standby position by a certain amount from the sheet width and stands by. In this case, the entrance roller 203 functions also as a registration roller. In other words, as illustrated in FIG. 6(*b*), when the first sheet P1 is fed into the postprocessing apparatus 201 and the front end of the sheet is detected by the entrance sensor 202, the front end of the sheet abuts against the nip of the entrance roller 203. The sheet P1 is conveyed by the sheet discharge roller 102*f* of the image forming apparatus 101 by a distance to produce a certain amount of bending. After being conveyed by the distance, the entrance roller 203 starts rotation. This performs the skew correction of the sheet P1. FIGS. 6(*a*) and 6(*b*) illustrate a status at that time.

Figure 7:
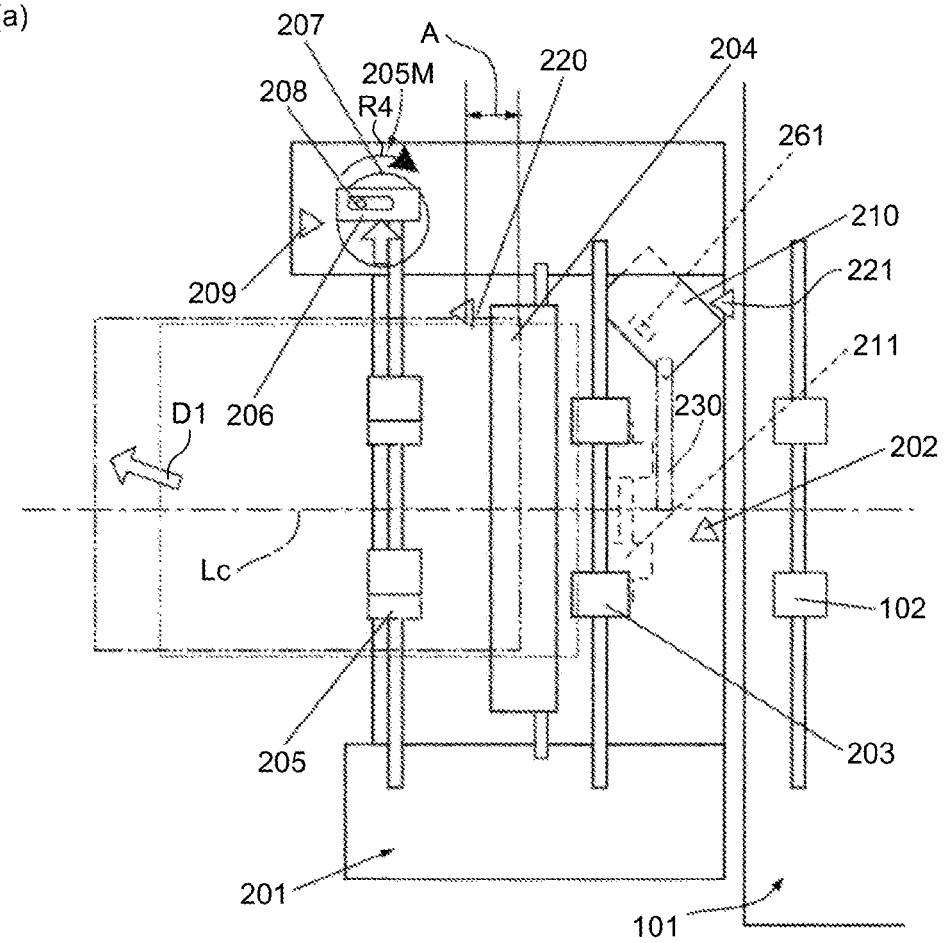
FIGS. 7(*a*) and 7(*b*) are operation illustration diagrams when a sheet is skewing by the postprocessing apparatus in FIG. 1, FIG. 7(*a*) being a plan view and FIG. 7(*b*) being a schematic side view.
Figure 7:
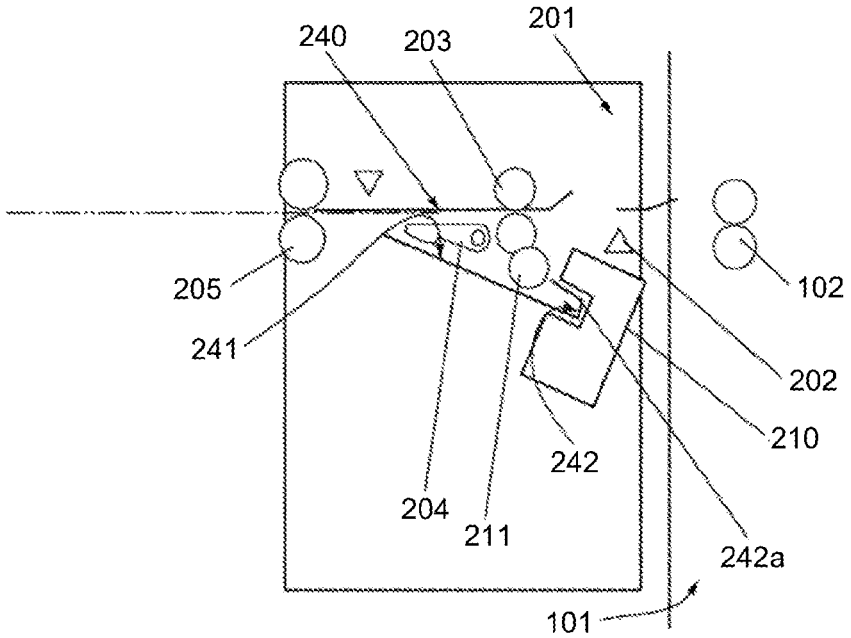

FIGS. 7(*a*) and 7(*b*) are diagrams illustrating a status when the rear end of the sheet leaves the nip of the entrance roller 203 and passes by the branch path 241. For the sheet P1, the amount of conveyance is counted based on the detection information of the rear end of the sheet by the entrance sensor 202, and its position information of the sheet conveyance position is informed to the CPU 270*a*. When the rear end of the sheet passes by the nip of the entrance roller 203, the entrance roller 203 stops its rotation for the reception of the next sheet P2. At the same timing therewith, the shift cam 207 forming the principal part of the shift conveying unit 205M rotates in a direction indicated by an arrow R4 in FIG. 7(*a*) (clockwise in the drawing), and the sheet discharge roller 205 starts moving in the sheet width direction as the shaft direction while nipping the sheet P1. The sheet P1 is thereby conveyed while skewing in a direction indicated by an arrow D1 in FIG. 7(*a*). When the sheet end detecting sensor 220 attached to or incorporated into the binder 210 detects the side end of the sheet P, the shift cam 207 stops and then rotates in the opposite direction. The shift cam 207 stops when the sheet end detecting sensor 220 is in a status of not detecting the sheet P. When the above operation is completed and the rear end of the sheet is at a predetermined position passing by the tip of the bifurcating claw 204, the sheet discharge roller 205 stops.

Figure 8:
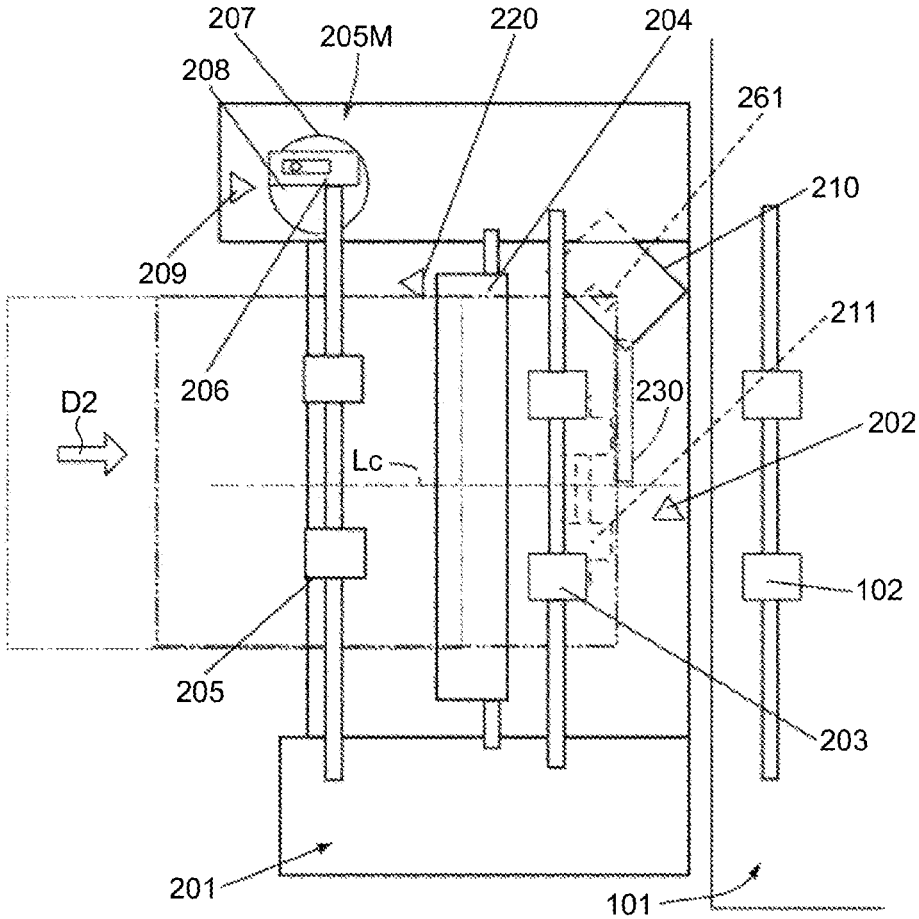
FIGS. 8(*a*) and 8(*b*) are operation illustration diagrams when a sheet is returned to a branch path by the postprocessing apparatus in FIG. 1, FIG. 8(*a*) being a plan view and FIG. 8(*b*) being a schematic side view.
Figure 8:
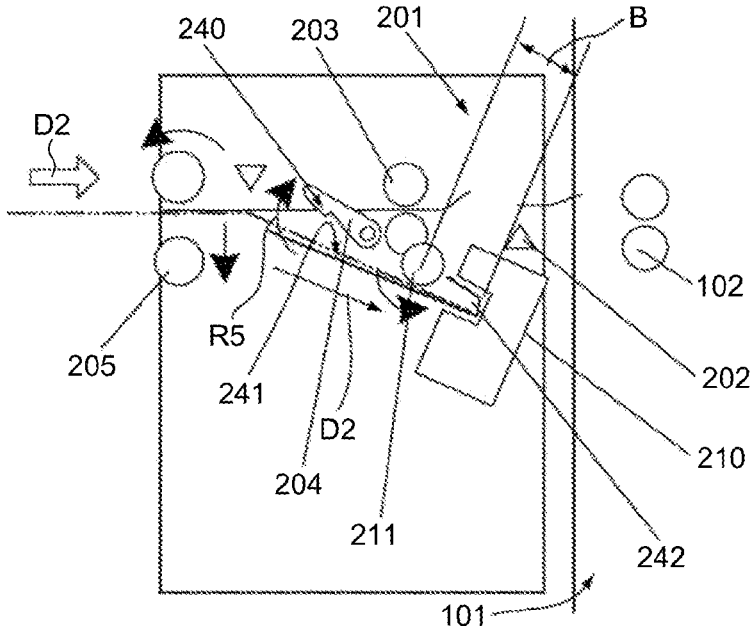

FIGS. 8(*a*) and 8(*b*) are diagrams illustrating a status when the sheet P1 is switched back to align the conveying direction of the sheet P1. The bifurcating claw 204 in the status in FIGS. 8(*a*) and 8(*b*) rotates in a direction indicated by an arrow R5 in the drawing to switch the conveying path to the branch path 241, and then, the sheet discharge roller 205 rotates in the opposite direction. The sheet P1 is thereby switched back to a direction indicated by an arrow D2, and the rear end of the sheet is fed into the branch path 241.

The sheet discharge roller 205 passes the sheet fed into the branch path 241 to the return roller 211. After passing this sheet, the sheet discharge roller 205 releases the nip. The return roller 211 performs abutting alignment against the abutting surface 242 and stops. The return roller 211 is set to produce weak conveying force so that when the sheet is abutted, a slip occurs. The abutting alignment will be described below in detail.

Through the abutting of the rear end of a sheet, the rear end of the sheet is aligned against the abutting surface 242. It is designed so that when the rear end of the sheet is aligned against the abutting surface 242, the return roller 211 stops, thereby preventing the sheet from being further conveyed and buckling.

Figure 9:
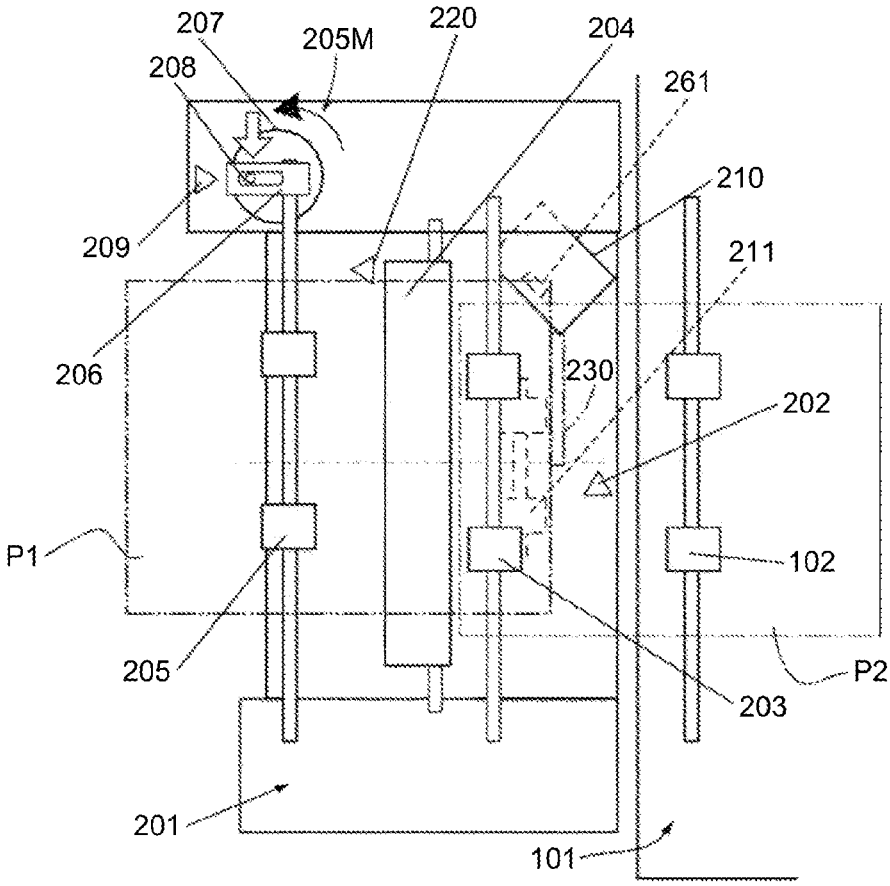
FIGS. 9(*a*) and 9(*b*) are operation illustration diagrams when a preceding sheet is being held in the branch path, and the next sheet is being fed by the postprocessing apparatus in FIG. 1, FIG. 9(*a*) being a plan view and FIG. 9(*b*) being a schematic side view.
Figure 9:
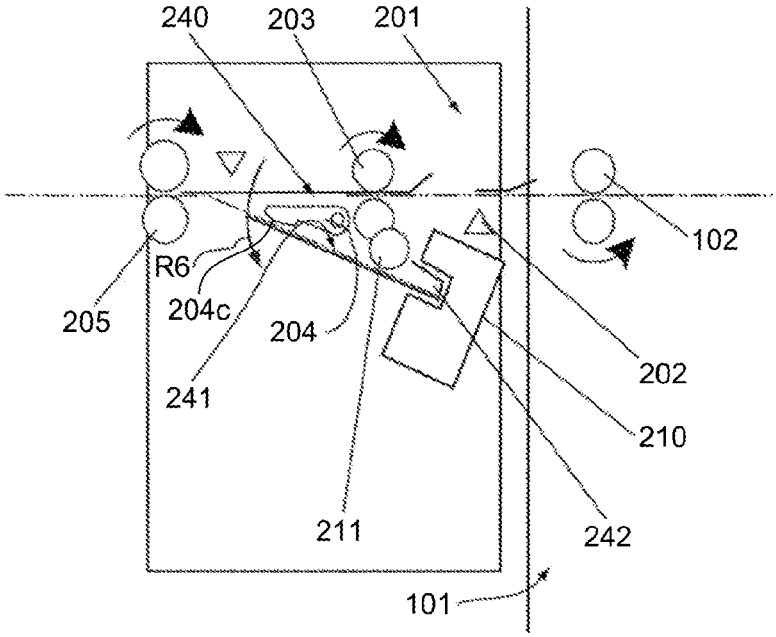

FIGS. 9(*a*) and 9(*b*) are diagrams illustrating a status when the first sheet P1 is made standby and the next second sheet P2 is being fed. After the first sheet P1 is aligned against the abutting surface 242, the bifurcating claw 204 rotates in a direction indicated by an arrow R6. A contact surface 204*c*, which is the undersurface of the bifurcating claw 204, thereby firmly presses the rear end of the sheet positioned on the branch path 241 against the surface of the branch path 241 to make it immovable (immovable even by the movement of the succeeding sheet) and stands by. Upon the succeeding second sheet P2 being fed from the image forming apparatus 101, the entrance roller 203 performs skew correction thereon in the same manner as with the preceding sheet P1. Subsequently, at the same time with the start of the rotation of the entrance roller 203, the sheet discharge roller 205 returns from the nip released state to the nip state and starts its rotation in the conveying direction.

Figure 10:
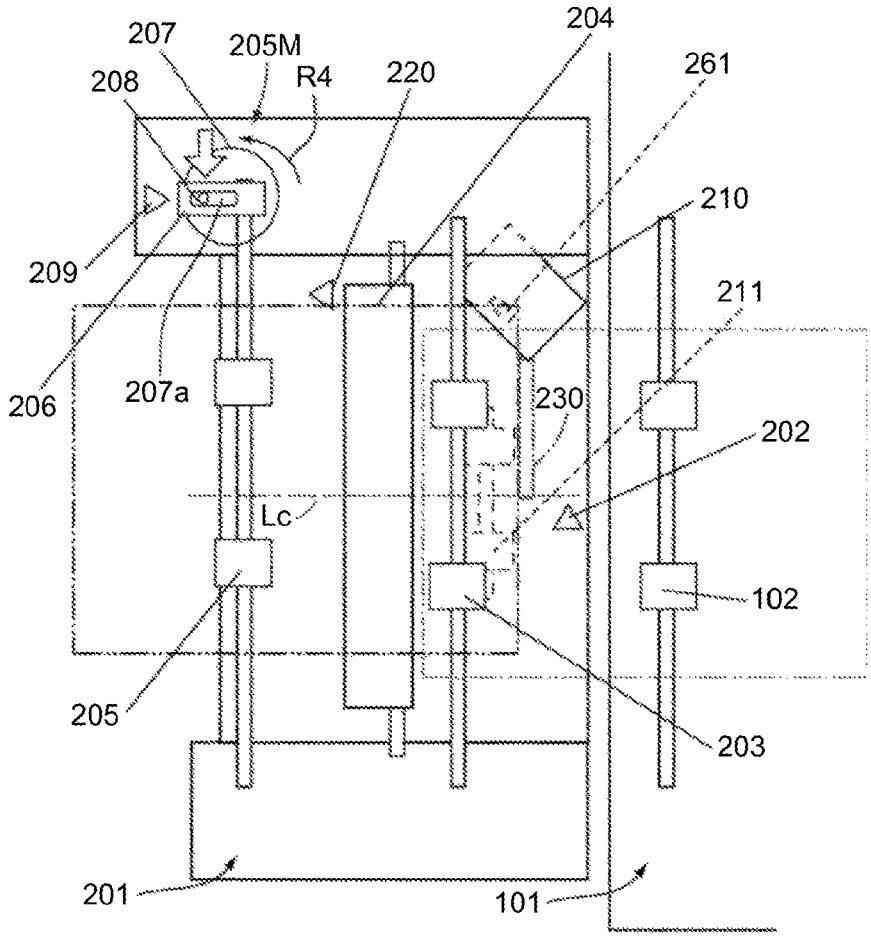
FIGS. 10(*a*) and 10(*b*) are operation illustration diagrams when a preceding sheet and the next sheet are successively held in the branch path and a sheet bundle is being stacked on a conveying path by the postprocessing apparatus in FIG. 1, FIG. 10(*a*) being a plan view and FIG. 10(*b*) being a schematic side view.
Figure 10:
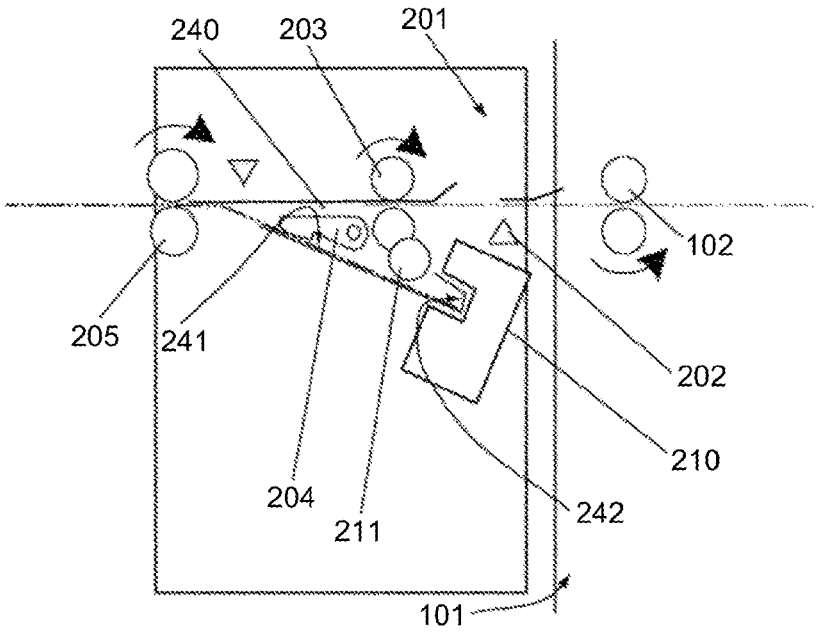

FIGS. 10(*a*) and 10(*b*) are diagrams illustrating a status when the second sheet P2 is being fed.

Assume that after the status in FIGS. 9(*a*) and 9(*b*), the second sheet P2 and further the third and following sheets P3, . . . , Pn have been conveyed. Also in this case, the operations illustrated in FIGS. 7(*a*) and 7(*b*) and FIGS. 8(*a*) and 8(*b*) are performed so that the sheets successively conveyed from the image forming apparatus 101 are moved to a target position set in advance and stacked, and then the sheet bundle PB in an aligned state is stacked in the sheet conveying path 240 and the branch path 241.

FIGS. 11(*a*) and 11(*b*) are diagrams illustrating a status when the last paper Pn is aligned to form the sheet bundle PB. When the last sheet Pn is made into the sheet bundle PB in an aligned state to complete the operation, the sheet discharge roller 205 rotates in the conveying direction by a certain amount and then stops. This operation eliminates bending possibly occurring when the rear end of a sheet is abutted against the abutting surface 242. The bifurcating claw 204 then rotates in a direction indicated by an arrow R5 in the drawing to separate the contact surface 204*c* from the branch path 241, thereby releasing the pressing force against the sheet bundle PB. This causes the sheet bundle PB to be released from the binding force by the bifurcating claw 204 and to be conveyed by the sheet discharge roller 205.

Figure 12:
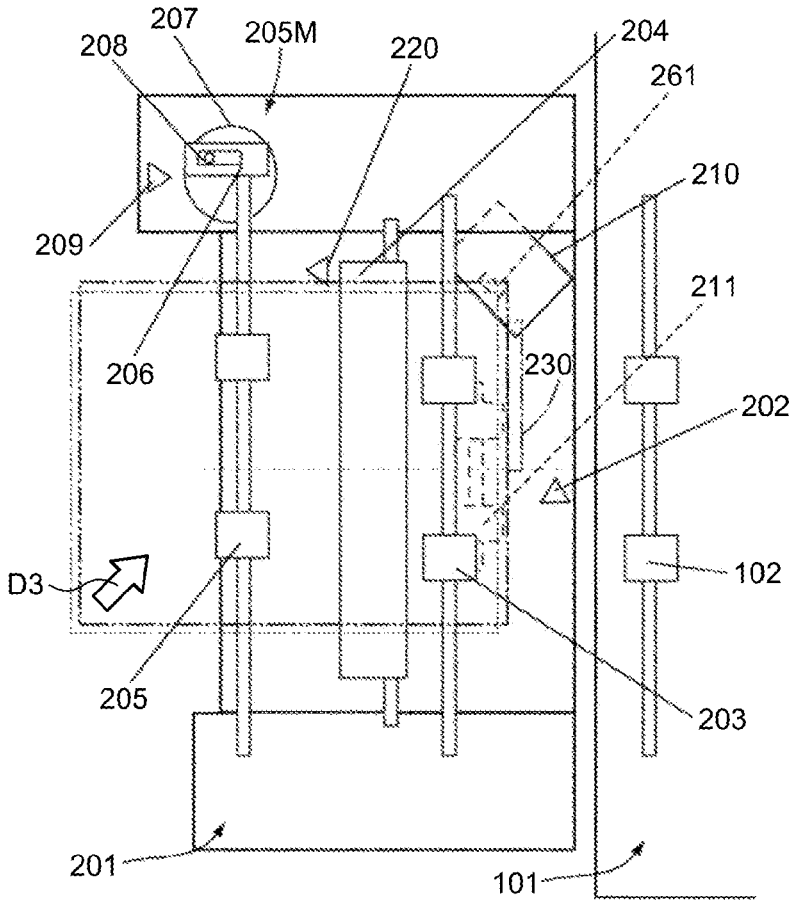
FIGS. 12(*a*) and 12(*b*) are operation illustration diagrams of binding processing on the sheet bundle with a binder after the sheet bundle is created by the postprocessing apparatus in FIG. 1, FIG. 12(*a*) being a plan view and FIG. 12(*b*) being a schematic side view.
Figure 12:
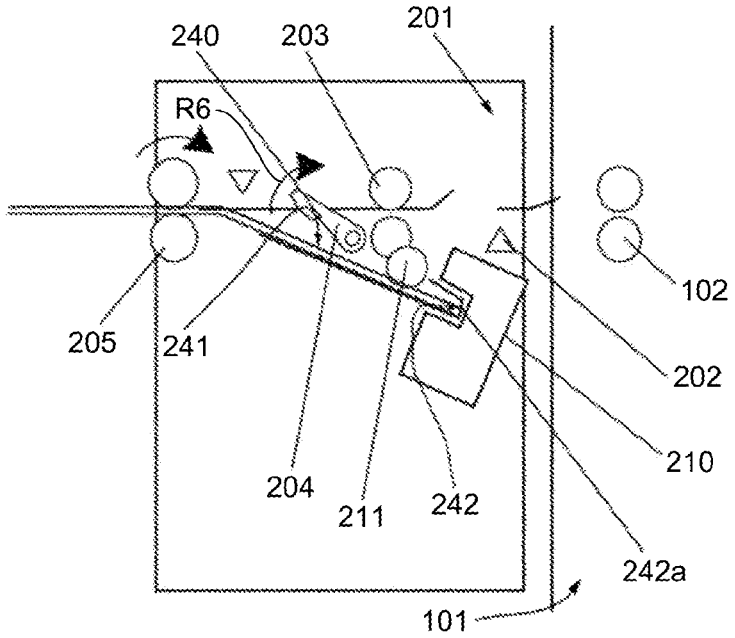

FIGS. 12(*a*) and 12(*b*) are diagrams illustrating a status during binding operation.

The binder 210 is driven to press and draw the sheet bundle through the tooth form 261, thereby entangling fibers and coupling the sheets to perform binding.

In this process, the binder 210 moves in a direction indicated by an arrow D3 in the drawing by a distance to allow the position of the tooth form 261 of the binder 210 to coincide with a sheet processing position and stops. This causes the width direction processing position of the sheet bundle PB to coincide with the position of the tooth form 261 in the conveying direction and the width direction. In this process, the bifurcating claw 204 rotates in a direction indicated by an arrow R6 in the drawing and returns to a sheet receiving status. The drive motor 265 is then turned on to press and draw the sheet bundle PB through the tooth form 261, thereby performing the crimp binding.

Thus, the sheet bundle PB aligned on the postprocessing apparatus is performed with the crimp binding as binding processing by the postprocessing apparatus, and then the sheet bundle PB subjected to the binding processing is stacked on a discharge tray. In some cases, the binding processing may be performed by a stapler using metal staples.

In the operation for ensuring alignment in FIGS. 5(*a*) and 5(*b*) to FIGS. 11(*a*) and 11(*b*), the sheet passed from the sheet discharge roller 205 is subjected to the abutting alignment by the return roller 211 on the abutting surface 242, which is positioned further inside than the return roller 211. In this case, the sheet bundle PB can be drawn into the branch path 241 and stacked. This results in a relatively small amount of deviation between the tooth form 261 of the binder 210 and the processing position of the sheet bundle PB after stacking, and hence, a required amount of position adjustment of the binder 210 can be zero or very small, thus downsizing the rail member of the binder 210 and improving installability.

The first embodiment performs drawing with the binder 210, which can be replaced with a binder of some ways of binding such as half blanking, cutting and bending, and cutting and bending and further inserting into a hole to produce the same effect.

Figure 13:
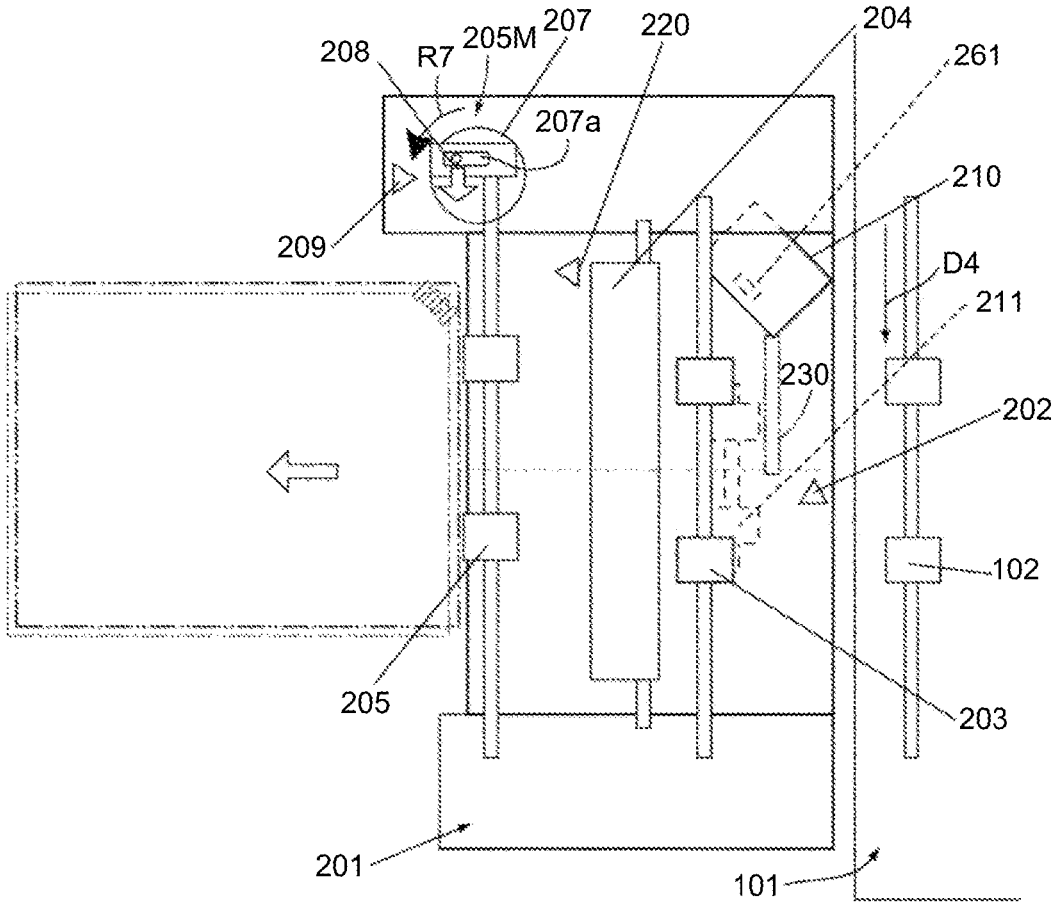
FIGS. 13(*a*) and 13(*b*) are operation illustration diagrams of discharging the sheet bundle bound by the postprocessing apparatus in FIG. 1, FIG. 13(*a*) being a plan view and FIG. 13(*b*) being a schematic side view.
Figure 13:
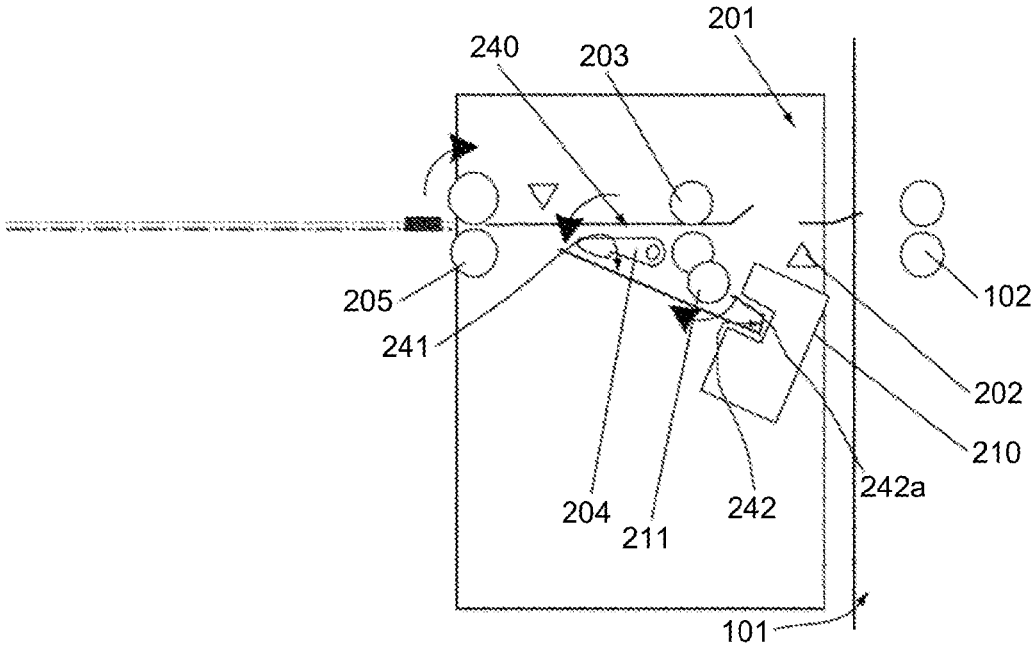

FIGS. 13(*a*) and 13(*b*) are diagrams illustrating a status when the sheet bundle PB is discharged. The sheet bundle bound as illustrated in FIGS. 12(*a*) and 12(*b*) is discharged through the rotation of the sheet discharge roller 205. After the sheet bundle PB is discharged, the shift cam 207 rotates in a direction indicated by an arrow R7 to return to the home position (the position in FIGS. 5(*a*) and 5(*b*)). In parallel therewith, the binder 210 moves in a direction indicated by an arrow D4 in the drawing to return to the home position (the position in FIGS. 5(*a*) and 5(*b*)). This completes the aligning operation and the binding operation of one copy (one volume) of the sheet bundle PB. When there is the next copy, the operations in FIGS. 5(*a*) and 5(*b*) to FIGS. 11(*a*) and 11(*b*) are repeated to create one copy of the crimp-bound sheet bundle PB similarly.

In the foregoing, the sheet fed from the sheet discharge roller 205 into the branch path 241 is passed to the return roller 211. The sheet is conveyed by the return roller 211 on the branch path 241 in a direction along the width direction center line Lc and is subjected to the abutting alignment on the abutting surface 242.

The sheet is subjected to the abutting alignment on the abutting plate 242*a* with the return roller 211, thereby causing bending in the sheet and performing skew correction. In this process, if the distance B from the return roller 211 to the abutting plate 242*a* as the reference fence is short, bending is not likely to occur, but variations in the accuracy of alignment by bending are not likely to occur. A long distance B from the abutting plate 242*a* to the return roller 211 lowers the likelihood of the occurrence of variations, because the amount of movement of the front end of the sheet is large (because the turning radius is large) even when the skew amount (a tilting angle) is the same.

The return roller 211 is provided on the width direction center of the sheet. This provides the effect that when the return roller is located at the width direction center of the conveying path with respect to the sheet, variations in the accuracy of alignment by the skew correction are least likely to occur.

The above-described abutting alignment will be described in further detail.

In FIG. 7(*a*), the reference A denotes a distance from a position in the sheet conveying direction where the end of the sheet is to be detected by the sheet end detecting sensor 220 to the rear end of the sheet, after the sheet discharge roller 205 starts moving in the sheet width direction as the shaft direction.

FIG. 8(*b*) illustrates a case in which the sheet discharge roller 205 rotates in the opposite direction to convey the sheet toward the abutting surface 242. Illustrated is a case in which after receiving the sheet, the return roller 211 conveys the sheet and abuts it against the abutting surface 242 to perform alignment in the conveying direction. A distance from a return roller nip (to be precise, a nip between the return roller 211 and a guide plate of the branch path 241) to the abutting surface 242 is denoted as B. In this case, along with the operation of the abutting alignment (the skew correction), the distance A and the distance B are made nearly the same. The feature of the present invention is to obtain the effect of minimizing the deviation of the sheet in the width direction by setting in that way.

Described below is the effect provided by setting A and B nearly the same.

Even when the skew correction is performed by the entrance roller 203 as illustrated in FIGS. 6(*a*) and 6(*b*) prior to performing the binding operation, skew may occur during conveyance by the sheet discharge roller 205 of the postprocessing apparatus. When skew occurs, the sheet will be eventually in line with the abutting surface 242 by being abutted against the abutting plate 242*a*, and thus the skew correction is performed (the sheet rotates to become parallel to the abutting plate 242*a*). In this process, the return roller 211 nipping the sheet is the center of the rotation.

Figure 14:
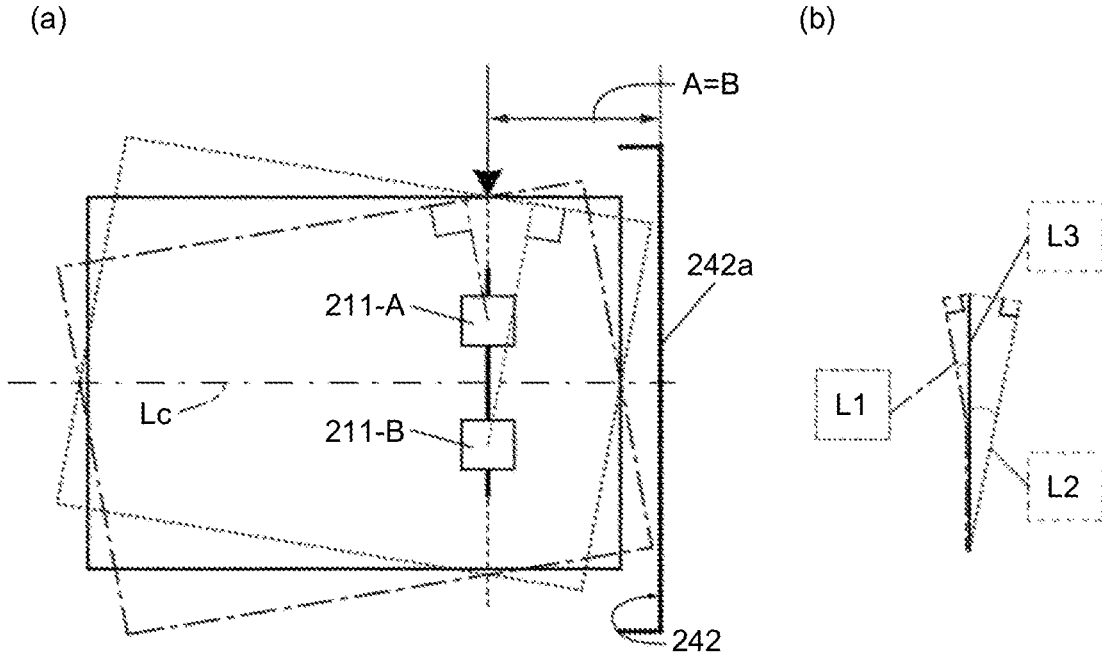
FIGS. 14(*a*) and 14(*b*) are operation illustration diagrams when a distance A and a distance B are the same when a sheet is skew-corrected by the postprocessing apparatus in FIG. 1, FIG. 14(*a*) being a plan view and FIG. 14(*b*) being a diagram illustrating the amount of deviation according to the skewing state of each sheet.

FIG. 14(*a*) is a diagram when a sheet is conveyed on the branch path 241 in a direction along the width direction center line Lc and is abutted against the abutting plate 242*a*, with A and B equal as described above. With A and B equal, when the sheet is conveyed by the return roller 211 and is abutted against the abutting plate 242*a*, the sheet end detecting sensor 220 aligns the sheet at a position indicated by an arrow in the drawing (on the shaft of the return roller 211). In this case, as illustrated in the drawing, the sheet with or without skew is abutted against the abutting plate 242*a* while being aligned at the sheet arrow position. In the drawing, a one-dot chain line sheet is a sheet skewed with the near side preceded, and a broken line sheet is a sheet skewed with the far side preceded. When the skewed sheet is conveyed by the return roller 211 and is abutted against the abutting plate 242*a*, the skew is corrected as in a solid line sheet in the drawing (the sheet position after correction is different from the solid line sheet).

Because the center of rotation differs in accordance with the direction of the skew and the one-dot chain line sheet skewed with the near side preceded is abutted against the abutting plate 242*a* with its near-side sheet corner first, its turning radius is large. The sheet is likely to rotate centering on a return roller 211-A (far side) in the return roller 211. In contrast, because the broken line sheet skewed with the far side preceded is abutted against the abutting plate 242*a* with its far-side sheet corner first, the sheet is likely to rotate centering on a return roller 211-B (near side).

FIG. 14(*b*) is a diagram illustrating a distance to the sheet end face from the return roller 211-B (near side) when the sheet skewed is corrected. The reference L1 represents the distance of the sheet end face (from the return roller 211-B (near side)) after the one-dot chain line sheet with the near side preceded is skew-corrected. The reference L2 represents the distance of the sheet end face after the broken line sheet with the far side preceded is skew-corrected. The reference L3 represents the distance of the sheet end face of the solid line sheet free of skew. The maximum amount of the alignment deviation of a sheet bundle is represented by (L1−L3)+(L3−L2).

Thus, FIGS. 14(*a*) and 14(*b*) are diagrams when the above-described A and B are the same. Described below are drawings when A differs from B.

Figure 15:
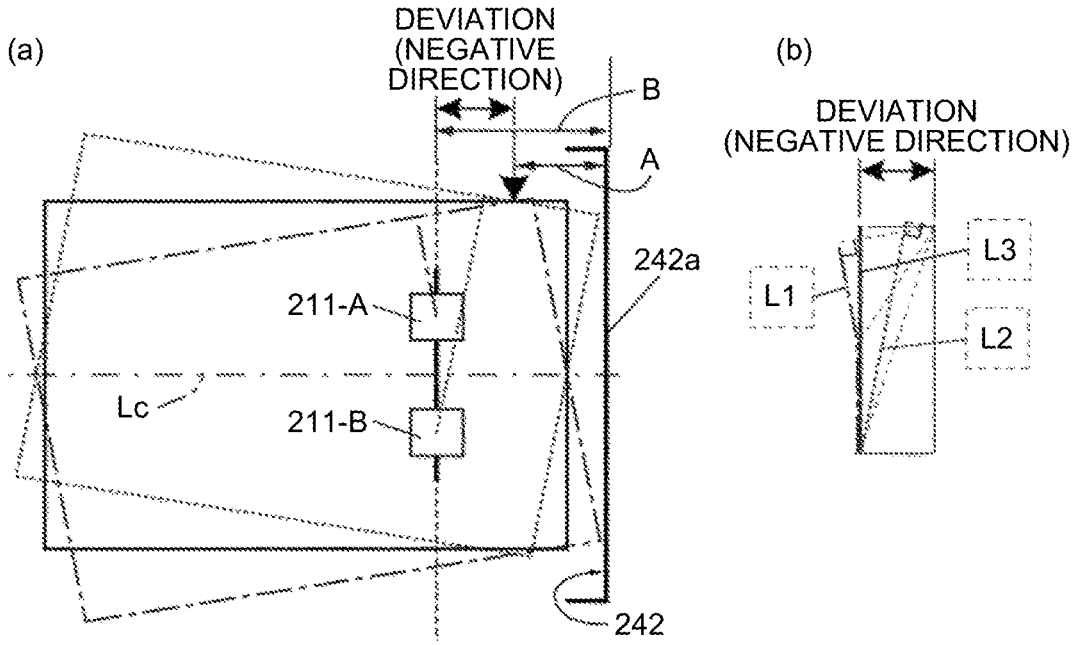
FIGS. 15(*a*) and 15(*b*) are operation illustration diagrams when the distance A is shorter than the distance B when a sheet is skew-corrected by the postprocessing apparatus in FIG. 1, FIG. 15(*a*) being a plan view and FIG. 15(*b*) being a diagram illustrating the amount of deviation according to the skewing state of each sheet.

FIGS. 15(*a*) and 15(*b*) are diagrams when the sheet end detecting sensor 220 is deviated close to the position of the abutting plate 242*a* (A<B).

Assume that the deviation direction of an arrow in the drawing is the negative direction.

Figure 16:
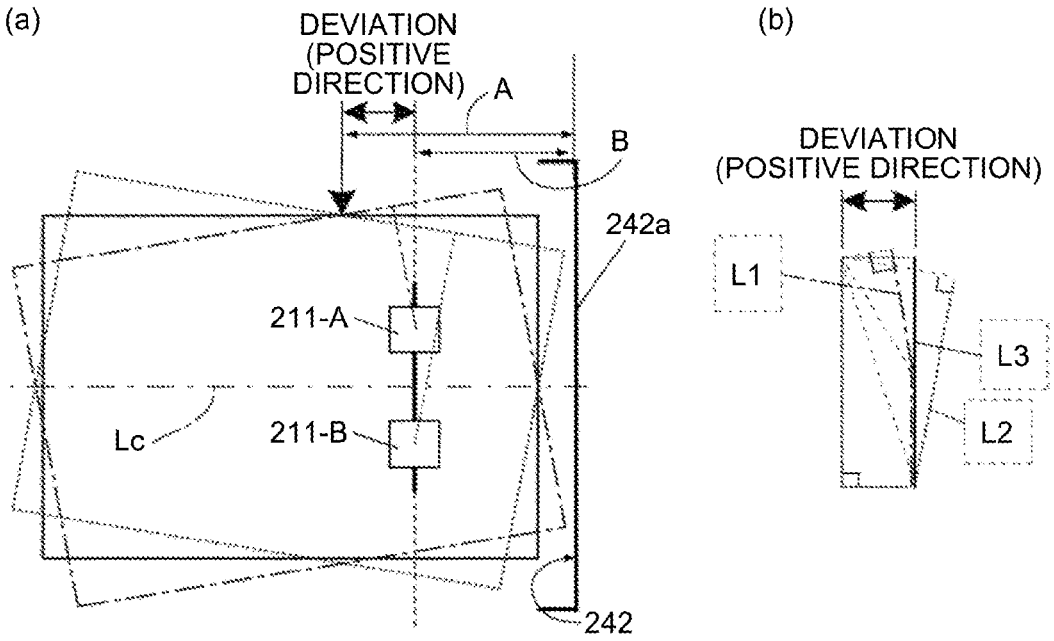
FIGS. 16(*a*) and 16(*b*) are operation illustration diagrams when the distance A is longer than distance B when a sheet is skew-corrected by the postprocessing apparatus in FIG. 1, FIG. 16(*a*) being a plan view and FIG. 16(*b*) being a diagram illustrating the amount of deviation according to the skewing state of each sheet.

FIGS. 16(*a*) and 16(*b*) are diagrams when the sheet end detecting sensor 220 is deviated apart from the position of the abutting plate 242*a* (A>B).

Assume that the deviation direction of an arrow in the drawing is the positive direction.

Figure 17:
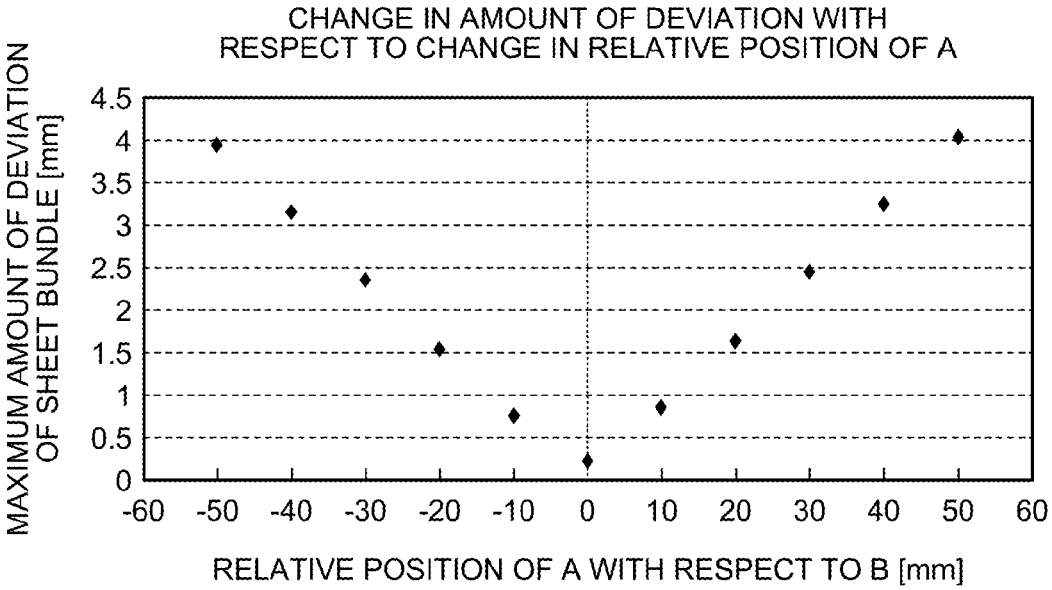
FIG. 17 is a change characteristics illustration diagram of the width direction deviation of a sheet bundle according to a relative displacement between the distance A and the distance B when a sheet is skew-corrected by the postprocessing apparatus in FIG. 1.

FIG. 17 illustrates the amount of alignment deviation when the sheet end detecting sensor 220 is deviated as in FIG. 15(*a*) and FIG. 16(*a*) and the position of A changes relatively with respect to B.

In FIG. 17, the horizontal axis is the relative position of A with respect to the distance B, and the positive direction and the negative direction correspond to FIG. 15(*a*) and FIG. 16(*a*), respectively. The vertical axis is the maximum amount (theoretical value) of deviation of a sheet bundle calculated with (L1−L3)+(L3−L2).

The conditions used in the calculations here are as follows:

Skew amount: (for the near side preceding and the far side preceding, respectively) 4 mm, 100 mm (angle: 2.3 degrees)

Sheet size: A3T (297×420)

Position of the return roller 211: the return roller conveyance center (illustrated by a one-dot chain line) is the same as the sheet conveyance center.

Pitch of the return roller 211 (the distance from 211-A to 211-B): 62 mm As illustrated in FIG. 17, at the zero position, where A and B are nearly the same, the maximum amount of deviation of the sheet bundle is minimized.

In other words, in the present invention, the distances A and B are set to be nearly the same (A≈B), where the distance A is a distance from the position in the conveying direction of a sheet whose end is detected by the sheet end detecting sensor 220 to the rear end of the sheet and the distance B is a distance from return roller nip to the abutting surface 242. This setting enables skew correction during the operation of abutting a skewing (tilting) sheet against the abutting surface 242. At the same time therewith, it is clear that the amount of width direction deviation of a sheet bundle is minimized, thereby improving the accuracy of width direction alignment of the sheet bundle.

Thus, in the postprocessing apparatus 201 of the first embodiment, a sheet is shift-conveyed by the shift conveying unit 205M by a predetermined amount to a position at which the side of the sheet is detected by the sheet end detecting sensor 220 (the width direction detector). After that, the sheet is conveyed onto the stacking unit as the conveying path, passed to the return roller 211, and abutted against the reference fence 242*a*. In this processing, the distances A and B are set to be nearly the same, where the distance A is a distance from the conveying direction position of the side of the sheet detected by the sheet end detecting sensor 220 to the rear end of the sheet and the distance B is a distance from the return roller on the stacking unit to the reference fence. This can minimize the amount of width direction deviation of a sheet bundle, thereby improving the accuracy of width direction alignment of the sheet bundle, and eliminate a width direction aligning unit on the stacking unit, thereby simplifying the configuration of the apparatus. Furthermore, because the width direction aligning unit is not installed in the postprocessing apparatus 201, its configuration can be simplified.

In the postprocessing apparatus of the first embodiment, in the binding mode, a sheet bundle is stacked on the conveying path and the branch path through the operations in FIGS. 6(*a*) and 6(*b*) to FIGS. 11(*a*) and 11(*b*). After that, the aligned sheet bundle is bound by the binder 210, and the bound sheet bundle is discharged by the sheet discharge roller 205 and the return roller 211.

Figure 18:
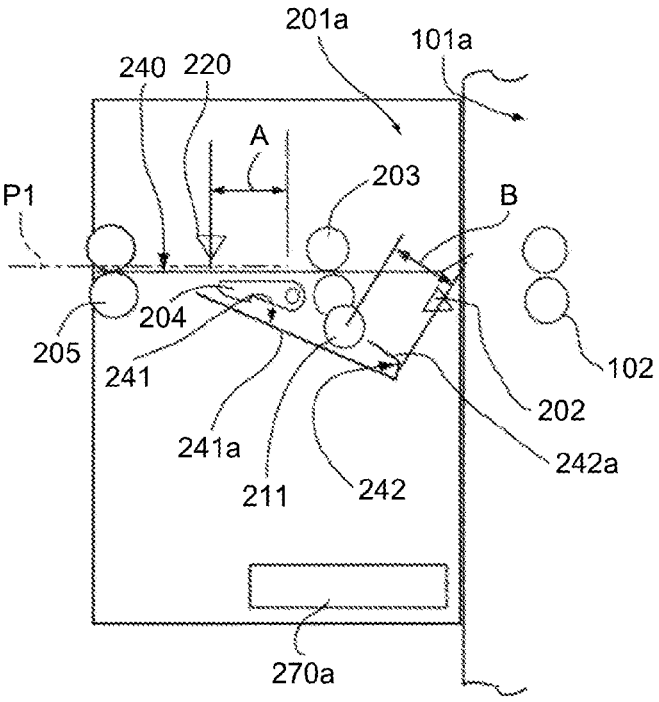
FIG. 18 is a schematic side view of a postprocessing apparatus with a binder eliminated as another embodiment according to the present invention.

According to circumstances, however, a postprocessing apparatus 201*a* without the binder 210 may be configured as a second embodiment. As illustrated in FIG. 18, because this postprocessing apparatus 201*a* of the second embodiment has the same configuration as the postprocessing apparatus 201 of the first embodiment with the binder eliminated, a redundant description will be omitted.

This postprocessing apparatus 201*a* of the second embodiment also sets the distances A and B the same, where the distance A is a distance from the conveying direction position of a sheet whose end is detected by the sheet end detecting sensor 220 to the rear end of the sheet and the distance B is a distance from the return roller to the abutting surface 242. This setting enables skew correction while the sheet is abutted against the abutting surface 242, and at the same time, leads to improved accuracy of width direction alignment of a sheet bundle with the minimum amount of width direction deviation of the sheet bundle.

Having been stacked on the conveying path and the branch path, the sheet bundle subjected to the aligning processing is immediately, without being bound, discharged by the sheet discharge roller 205 and the return roller 211. Because of this, alignment only to stack and bind sheets is performed as postprocessing, thereby stacking the sheet bundle on a discharge tray with high precision. Furthermore, such a configuration can simplify the apparatus and reduce costs and is suitable for performing various kinds of binding processing on a sheet bundle of a relatively small number of discharged sheets using a desired binder.

The postprocessing apparatuses 201 and 201*a* of the first and second embodiments, respectively, receive successively the feed of sheets with four-color tone images formed and abut the received sheets against the abutting surface 242, thereby performing skew (tilting) correction on the sheets. At the same time therewith, the amount of width direction deviation of the sheet bundle is minimized, thereby improving the accuracy of width direction alignment of the sheet bundle. Thus, the postprocessing apparatuses 201 and 201*a* do not have to install therein a shifting device that corrects the amount of lateral deviation of a sheet, which allows downsizing of the postprocessing apparatus to improve its installability to an image forming apparatus 101*a* and reduce costs. Furthermore, this can downsize the overall shape as an image forming system formed by combining the image forming apparatus 101*a* and the postprocessing apparatus 201*a*.

Figure 19:
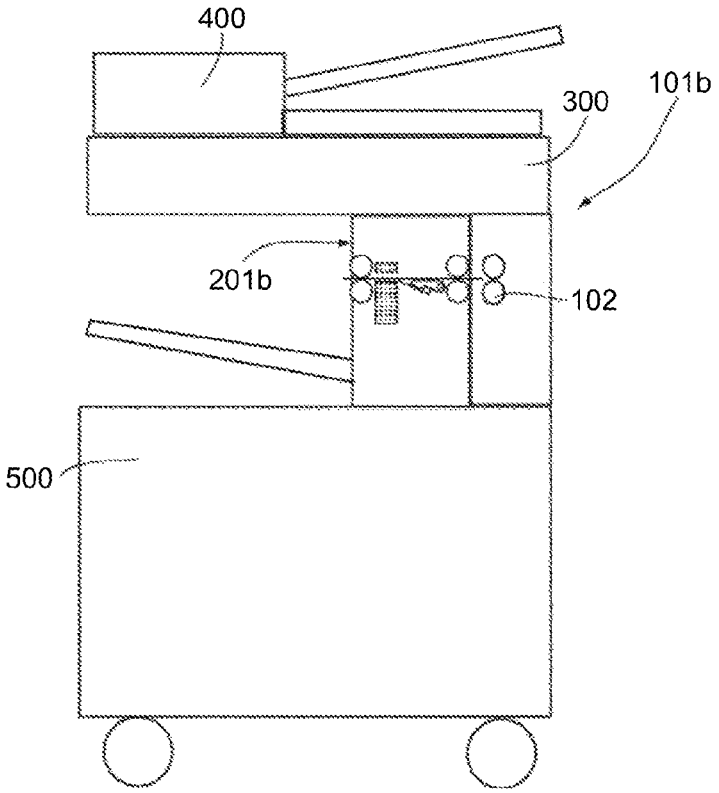
FIG. 19 is an overall configuration diagram of a postprocessing apparatus and an image forming apparatus that incorporates the postprocessing apparatus as another embodiment according to the present invention.

As illustrated in FIG. 19, a postprocessing apparatus 201*b* may be installed inside an image forming apparatus 101*b* as an image forming apparatus having a postprocessing apparatus of a third embodiment. Also in this case, the overall shape of the image forming apparatus 101*b* including the postprocessing apparatus 201*b* can be downsized.

In place of the described color copying machine as the image forming apparatus, the present invention can be applied to image processing apparatuses such as a printer and a fax machine.

Other than the image forming system formed by combining and connecting the color copying machine 101 and the postprocessing apparatus 201 described above, the image forming system can be adopted to image processing systems in general such as a printer, a fax machine, and a scanner.

According to the present invention, a sheet is shifted by a predetermined amount to a position at which a side of the sheet is detected by the width direction detector by the shift conveying unit, and conveyed onto the stacking unit and passed to the conveying unit as a rotating body, which is the return roller for example, to be abutted against the abutting unit. Distances A and B are made nearly the same, where the distance A is a distance from the conveying direction position of the side of the sheet detected by the width direction detector to the rear end of the sheet and the distance B is a distance from the return roller as the conveying unit on the stacking unit to the abutting unit. This can minimize the amount of width direction deviation of the sheet bundle and improve the accuracy of width direction alignment of the sheet bundle. Because the width direction aligning unit on the stacking unit is eliminated and is not used, the configuration of the postprocessing apparatus can be simplified.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A postprocessing apparatus, comprising:

a stacking unit configured to stack and process a sheet;

an abutting unit that is provided on the stacking unit and configured to abut a rear end of the sheet to correct a position of the sheet in a sheet conveying direction;

a conveying unit including a rotating body that conveys the sheet to abut the rear end of the sheet against the abutting unit on the stacking unit;

a shift conveying unit that is provided on a sheet conveying path at an upstream side of the stacking unit and configured to shift the sheet in a width direction perpendicular to the sheet conveying direction while conveying the sheet in the sheet conveying direction; and a width direction detector configured to detect a width direction position of the sheet on the stacking unit, wherein when the sheet on the conveying path is shifted by the shift conveying unit by a set amount until a side of the sheet is detected by the width direction detector, a distance from a position where the width direction detector is placed to a position of the rear end of the sheet, which is approximate to a bifurcation unit, in the sheet conveying direction corresponds as a distance A, and when the sheet on the stacking unit is abutted against the abutting unit by the conveying unit, a distance from a position where the conveying unit is placed to a position of the abutting unit in the sheet conveying direction corresponds as a distance B, such that the distances A and B are the same.

2. The postprocessing apparatus according to claim 1, wherein the conveying unit is provided at a width direction center of the sheet.

3. The postprocessing apparatus according to claim 1, wherein the conveying unit is a rotating body that rotates with a rotation axis thereof pointing in the width direction of the sheet.

4. The postprocessing apparatus according to claim 1, wherein the conveying unit is a pair of rotating bodies that are provided right and left in the width direction from the width direction center of the sheet.

5. The postprocessing apparatus according to claim 1, wherein the conveying unit is provided at a position close to the abutting unit.

6. The postprocessing apparatus according to claim 1, wherein the stacking unit bundles and stacks sheets and discharges the sheets to a discharge tray.

7. The postprocessing apparatus according to claim 1, wherein the stacking unit bundles and stacks sheets, performs binding processing on the sheets with a binder, and discharges the sheets to a discharge tray.

8. An image forming apparatus comprising a postprocessing apparatus, wherein the postprocessing apparatus comprises:

a stacking unit configured to stack and process a sheet;

an abutting unit that is provided on the stacking unit and configured to abut a rear end of the sheet to correct a position of the sheet in a sheet conveying direction;

a conveying unit including a rotating body that conveys the sheet to abut the rear end of the sheet against the abutting unit on the stacking unit;

a shift conveying unit that is provided on a sheet conveying path at an upstream side of the stacking unit and configured to shift the sheet in a width direction perpendicular to the sheet conveying direction while conveying the sheet in the sheet conveying direction; and a width direction detector configured to detect a width direction position of the sheet on the stacking unit, wherein when the sheet on the conveying path is shifted by the shift conveying unit by a set amount until a side of the sheet is detected by the width direction detector, a distance from a position where the width direction detector is placed to a position of the rear end of the sheet, which is approximate to a bifurcation unit, in the sheet conveying direction corresponds as a distance A, and when the sheet on the stacking unit is abutted against the abutting unit by the conveying unit, a distance from a position where the conveying unit is placed to a position of the abutting unit in the sheet conveying direction corresponds as a distance B, such that the distances A and B are the same.

9. An image forming system comprising a postprocessing apparatus, wherein the postprocessing apparatus comprises:

a stacking unit configured to stack and process a sheet;

an abutting unit that is provided on the stacking unit and configured to abut a rear end of the sheet to correct a position of the sheet in a sheet conveying direction;

a conveying unit including a rotating body that conveys the sheet to abut the rear of the sheet against the abutting unit on the stacking unit;

a shift conveying unit that is provided on a sheet conveying path at an upstream side of the stacking unit and configured to shift the sheet in a width direction perpendicular to the sheet conveying direction while conveying the sheet in the sheet conveying direction; and a width direction detector configured to detect a width direction position of the sheet on the stacking unit, wherein when the sheet on the conveying path is shifted by the shift conveying unit by a set amount until a side of the sheet is detected by the width direction detector, a distance from a position where the width direction detector is placed to a position of the rear end of the sheet, which is approximate to a bifurcation unit, in the sheet conveying direction corresponds as a distance A, and when the sheet on the stacking unit is abutted against the abutting unit by the conveying unit, a distance from a position where the conveying unit is placed to a position of the abutting unit in the sheet conveying direction corresponds as a distance B, such that the distances A and B are the same.

10. The postprocessing apparatus according to claim 1, wherein when the distances A and B are nearly the same, the sheet is conveyed by the conveying unit and is abutted against the abutting unit, the width direction detector aligns the sheet at a position on a shaft of the conveying unit.

11. The postprocessing apparatus according to claim 1, wherein when the distances A and B are nearly the same, a skew correction during operation of abutting a skewing sheet against the abutting unit is provided.

12. The postprocessing apparatus according to claim 1, wherein when the distances A and B are nearly the same, an amount of width direction deviation of a sheet bundle is minimized.

13. The postprocessing apparatus according to claim 1, wherein the width direction detector is stationary.

14. The postprocessing apparatus according to claim 1, wherein the conveying unit as a rotating body is provided at a width direction center of the sheet and is provided as one pair of bodies spaced apart right and left in the width direction by a set spacing from a width direction center line of the sheet.

15. The postprocessing apparatus according to claim 14, wherein the one pair of bodies of the conveying unit are integrally supported by a rotating shaft that rotates with its rotation axis pointing in the width direction of the sheet.

16. The postprocessing apparatus according to claim 1, wherein the stacking unit branches off from a sheet conveying path and functions as a stacking unit that stacks and processes the sheets.

17. The postprocessing apparatus according to claim 1, further comprising a bifurcating claw provided at a rear stage of an entrance member.

* * * * *